US011435156B1

(12) United States Patent
Dellinger

(10) Patent No.: US 11,435,156 B1
(45) Date of Patent: Sep. 6, 2022

(54) SOUND SUPPRESSORS AND SUPPRESSOR SLEEVES INCORPORATING SILICA FIBERS

(71) Applicant: American Nano, LLC, Clemmons, NC (US)

(72) Inventor: Mitch Dellinger, Clemmons, NC (US)

(73) Assignee: AMERICAN NANO LLC., Clemmons, NC (US)

( * ) Notice: Subject to any disclaimer, the term of this patent is extended or adjusted under 35 U.S.C. 154(b) by 81 days.

(21) Appl. No.: 16/924,308

(22) Filed: Jul. 9, 2020

Related U.S. Application Data

(60) Provisional application No. 62/975,276, filed on Feb. 12, 2020, provisional application No. 62/872,330, filed on Jul. 10, 2019.

(51) Int. Cl.
*F41A 21/30* (2006.01)
*G10K 11/162* (2006.01)

(52) U.S. Cl.
CPC ..... *F41A 21/30* (2013.01); *G10K 11/162* (2013.01)

(58) Field of Classification Search
CPC ..... F41A 21/30; F41A 21/32
See application file for complete search history.

(56) References Cited

U.S. PATENT DOCUMENTS 1,763,286 A * 6/1930 Wilman ..... F41A 21/30 89/14.3
2,043,731 A * 6/1936 Bourne ..... F01N 1/006 89/14.4
2,271,892 A * 2/1942 Bourne ..... F04D 29/663 181/248
2,514,996 A * 7/1950 Faust, Jr. ..... F41A 21/34 181/223
2,583,366 A * 1/1952 Engels ..... F01N 1/24 181/252
3,667,570 A * 6/1972 WerBell, III ..... F41A 21/30 89/14.4
3,713,362 A * 1/1973 Charron ..... F41A 21/30 89/14.4
4,454,798 A * 6/1984 Shea ..... F41A 21/30 181/223
4,530,417 A * 7/1985 Daniel ..... F41A 21/30 181/252
4,576,083 A * 3/1986 Seberger, Jr. ..... F01N 1/08 89/14.4
4,974,489 A * 12/1990 Fishbaugh ..... F41A 21/30 89/14.4
5,078,043 A * 1/1992 Stephens ..... F41A 21/30 89/14.4
5,136,923 A * 8/1992 Walsh, Jr. ..... F41A 21/30 89/14.4
6,298,764 B1 * 10/2001 Sherman ..... F41A 21/36 89/14.2

(Continued)

*Primary Examiner* — Derrick R Morgan
(74) *Attorney, Agent, or Firm* — Morgan, Lewis & Bockius LLP

(57) ABSTRACT

Embodiments of the invention include sound suppressors, and/or sleeves for sound suppressors and/or barrels of firearms, incorporating mats, sheets, and/or powders of silica fibers and methods for producing such sound suppressors and sleeves. The silica fibers may be formed via electrospinning of a sol gel produced with a silicon alkoxide reagent, such as tetraethyl ortho silicate, alcohol solvent, and an acid catalyst.

17 Claims, 13 Drawing Sheets

(56) References Cited

U.S. PATENT DOCUMENTS

| | | | | |
|---|---|---|---|---|
| 8,196,701 | B1 * | 6/2012 | Oliver | F41A 21/30 89/14.4 |
| 9,982,959 | B2 * | 5/2018 | Washburn, III | F41A 21/30 |
| 10,111,783 | B1 * | 10/2018 | Dellinger | D01D 5/0015 |
| 10,458,737 | B2 * | 10/2019 | Schwartzkopf | F28F 13/003 |
| 10,794,651 | B2 * | 10/2020 | Crown | F41A 21/30 |
| 10,809,032 | B1 * | 10/2020 | Thomas | F41A 21/44 |
| 2009/0317446 | A1 * | 12/2009 | Tan | C04B 35/447 428/407 |
| 2014/0262602 | A1 * | 9/2014 | Moss | F41A 21/30 181/296 |
| 2015/0354422 | A1 * | 12/2015 | Liskey | F41A 21/30 89/14.4 |
| 2017/0328666 | A1 * | 11/2017 | Liskey | F41A 21/30 |
| 2018/0209757 | A1 * | 7/2018 | Hibbitts | F41A 21/44 |
| 2020/0248980 | A1 * | 8/2020 | Bragais | F41A 21/32 |
| 2020/0340777 | A1 * | 10/2020 | Yoon | F41B 11/89 |
| 2021/0333061 | A1 * | 10/2021 | Muceus | F41A 21/32 |
| 2021/0389076 | A1 * | 12/2021 | Turnblom | F41A 21/34 |

* cited by examiner

SOUND SUPPRESSORS AND SUPPRESSOR SLEEVES INCORPORATING SILICA FIBERS

RELATED APPLICATIONS

This application claims the benefit of and priority to U.S. Provisional Patent Application No. 62/872,330, filed on Jul. 10, 2019, and U.S. Provisional Patent Application No. 62/975,276, filed on Feb. 12, 2020, the entire disclosure of each of which is hereby incorporated herein by reference.

TECHNICAL FIELD

In various embodiments, the present invention relates to sound suppressors for firearms that incorporate silica fibers and/or fragments thereof, as well as to sleeves for firearm suppressors that incorporate silica fibers and/or fragments thereof.

BACKGROUND

Sound suppressors (or "silencers") are devices configured to be fit onto the muzzle of a firearm and that reduce the sound produced when the firearm is discharged. While sound suppressors have been available commercially for more than a century, the use of high-caliber ammunition and greater amounts of ammunition propellant represent sound-producing challenges that are increasingly difficult for a sound suppressor to overcome. In addition, many lightweight materials usable in sound suppressors are exotic, expensive, and/or lack durability for suppression of sound produced by hundreds, or even thousands of firings.

In contrast, silicon dioxide, i.e., silica, is one of the most abundant materials on Earth, being the major component of most types of sand. Silica has several advantageous properties that have resulted in its use in many different industries and products. For example, the high electrical resistance of silica has enabled its use as a high-performance insulator in microelectronic devices, e.g., as the gate-dielectric material in field-effect transistors. Silica is also utilized in the production of glass usable in many different applications. Optical fibers, for example, are fabricated utilizing silica and have enabled the formation and growth of worldwide optical telecommunications networks. Silica has also been utilized at the microscopic scale, as silica particles have been utilized as abrasive agents, as desiccants, and to form molds for investment casting of metallic materials. However, silica has yet to be utilized as a material in firearm sound suppressors. Utilization of silica may enable the fabrication of and use of sound suppressors that are inexpensive, that are more friendly to the environment, and that provide large amounts of surface area (and/or other characteristics) useful for the suppression of sound associated with the discharge of a firearm.

In addition, while conventional sound suppressors diminish the audible signature of firearm discharge to various levels, the suppressors often dramatically increase in temperature, particularly when used with firearms configured for rapid firing of multiple projectiles. Thus, there is a need for a lightweight solution to reduce or minimize the temperature rise of sound suppressors during use.

SUMMARY

In accordance with various embodiments of the present invention, silica fibers and/or powder formed therefrom are utilized as part of the structural matrix, and/or as a filler and/or wipe material, for firearm sound suppressors. The silica fibers themselves may be produced from a gelatinous material that is electrospun to form a fiber mat. The mat itself (or a portion thereof) may be utilized within the sound suppressor. In various embodiments, the mat is fragmented into a powder or dust, which may include, consist essentially of, or consist of fibrous fragments. The powder may be utilized to produce at least a portion of the structural matrix of the sound suppressor itself. In this manner, the advantageous characteristics of silica fibers and/or powder improve the sound-suppression capability of the sound suppressor while enabling the suppressor itself to be lightweight and inexpensive.

In other embodiments of the invention, silica fibers and/or powder formed therefrom are utilized within or as an insulating sleeve disposed around a sound suppressor, and/or around a portion of the firearm itself (e.g., all or a portion of the barrel). The insulating sleeves may be utilized with suppressors that themselves incorporate the silica fibers and/or powder, or they may be utilized with other conventional sound suppressors. Thus, embodiments of the present invention advantageously reduce or minimize the rise in temperature associated with firearm discharge, particularly that of the sound suppressor. In this manner, the reliability and lifetime of the suppressor, and the firearm itself, are enhanced.

In various embodiments, the silica fibers may be prepared by electrospinning a sol-gel, which may be prepared with a silicon alkoxide reagent, such as tetraethyl ortho silicate (TEOS), alcohol solvent, and an acid catalyst. In various embodiments, the sol-gel is produced via ripening of sol under controlled environmental conditions, and/or the properties of the sol or sol-gel during the ripening process are monitored, in order to identify various processing windows during which the electrospinning of the sol-gel may be successfully performed. As known in the art, a "sol" is a colloidal solution that gradually evolves towards the formation of a "gel," i.e., a diphasic system containing both a liquid phase and solid phase. Herein, the term "sol-gel" is used to refer to the gel produced from the sol-gel process that may be electrospun into fibers or a fibrous mat.

In various embodiments, the controlled environment for ripening the sol may involve controlled conditions in terms of humidity, temperature, and optionally barometric pressure. For example, the humidity may be controlled within the range of about 30% to about 90%, and the temperature may be controlled within the range of from about 50° F. to about 90° F. By controlling the environmental conditions during ripening, the gel may be electrospun during the time when spinning is optimal, which can occur in a very small window of only several minutes if the ripening process is accelerated by direct heat. When ripening the sol at a constant humidity in the range of about 50% to 80% and a temperature of about 60 to 80° F., the sol will ripen (gelatinize) in a few days, and the window for successful electrospinning may be expanded to at least several hours, and in some embodiments several days. The sol may therefore be ripened in an enclosure which may include one or more environmental monitors, such as a temperature reading device and/or a humidity reading device. Further, gases produced or released by the sol during the ripening process and/or relative weight of the sol may be monitored to determine a suitable or optimal time for electrospinning.

Once the sol is adequately ripened into a sol-gel, it is electrospun to form a mat of entangled silica fibers. Once electrospun, the silica fibers may have a variable diameter, such as in the range of from about 50 nm to 5 μm. In some embodiments, the fibers are predominately in the range of about 100 nm to about 2 or predominately in the range of about 200 to about 1000 nm.

In various embodiments, sound suppressors may define one or more internal chambers that incorporate therewithin one or more sheets of silica fibers. As utilized herein, a "sheet" of silica fibers refers to an electrospun mat of silica fibers (or portion thereof), with or without additional pressing or processing, or to pressed layers of powder (e.g., fibrous fragments) formed via fragmentation of electrospun silica fiber mats. Advantageously, the sheets of silica fibers provide large amounts of surface area for the trapping of gases produced during discharge of the firearm and can absorb large amounts of discharge-related heat without decomposing or being otherwise damaged. For example, the silica fiber sheets utilized in sound suppressors in accordance with embodiments of the invention have a large surface area (e.g., ranging from approximately 50 $m^2$/gram to approximately 100 $m^2$/gram, or even larger), thereby enabling a large gas- and sound-capture capability. The silica fiber-based structures are also advantageously thermally insulating and thus will thermally shield the various regions of the sound suppressors from heat from the firearm discharge and/or the surrounding environment, thereby increasing the lifetime of the sound suppressor.

In various embodiments, the structural matrix of the sound suppressor may include, consist essentially of, or consist of a composite material that incorporates the silica fibers, and/or powder therefrom. For example, silica fibers and/or powder may be mixed into a plastic material (e.g., a thermoplastic such as acrylonitrile butadiene styrene (ABS), polyethylene, and/or polycarbonate) and/or a metal material (e.g., aluminum), which may then be cast or molded into the shape of one or more portions of, or even the entirety of, the sound suppressor. In this manner, the silica fibers and/or powder provide increased mechanical strength and heat resistance to the sound suppressor while keeping it lightweight.

In various embodiments, the sound suppressor features a compartmented (or "honeycomb") tube, in which a central hollow bore, sized to accommodate the ammunition to be fired from the firearm, is surrounded by the compartments defined by the tube. Silica fibers, e.g., portions of silica fiber mats or sheets, are disposed in some or all of the compartments. The compartmented tube may be inserted within a cylindrical casing, which may include, consist essentially of, or consist of, e.g., a plastic and/or metallic material. In some embodiments, a compartmented sheet is shaped into the tube, and the silica fibers may be inserted into the compartments before and/or after the sheet is shaped into the tube. The tube or sheet may include, consist essentially of, or consist of one or more materials such as metals or plastics. The material of the tube may even be flammable (e.g., paper, cardboard, etc.); due to the advantageous heat-resistant properties imparted by the silica fibers, the tube will typically not be burned or otherwise damaged by the discharge of the firearm.

Sound suppressors in accordance with embodiments of the invention may be configured to reversibly attach (e.g., via a threaded connector) to the muzzle of any of various different types of firearms, including handguns, rifles, and other high-caliber firearms. The sound suppressor may dampen the sound resulting from discharge of the firearm. For example, sound suppressors in accordance with embodiments of the invention may reduce the sound resulting from firearm discharge by at least 10 dB, at least 20 dB, at least 30 dB, or at least 40 dB. Embodiments of the invention may also be utilized for larger weapons, including armaments or cannons mounted on tanks or other vehicles, mortars, and other artillery weapons; thus, as utilized herein, the term "firearm" refers to any such weapon, hand-held or otherwise, that fires a projectile such as a bullet from a barrel or muzzle when discharged. In addition, embodiments of the invention may be built into the muzzle of the firearm or other weapon, rather than being attachable thereto for firing. That is, "sound suppressors" as described herein include not only those configured for reversible attachment (e.g., via a connector) but also those that are part of a unitary silenced muzzle of the firearm. Thus, sound suppressors in accordance with embodiments of the invention may be unitary portions of the muzzle of the firearm or weapon, rather than having an attachment mechanism for attachment to the muzzle.

Sleeves for sound suppressors in accordance with embodiments of the invention may be configured to be removable (and therefore replaceable), or they may be a portion of a unitary "sleeved" suppressor (i.e., an insulating portion of a single component). For example, a suppressor sleeve in accordance with various embodiments may include, consist essentially of, or consist of a sheet of silica fibers that may be wrapped around all or a portion of a sound suppressor and/or all or a portion of the firearm itself (e.g., the barrel). In various embodiments, the sheet of silica fibers may be disposed on a flexible sheet or within a flexible envelope that may be wrapped around (and/or adhered to) the suppressor or firearm barrel. In other embodiments, the silica fibers may be disposed within a rigid sleeve (e.g., a cylindrical or hemi-cylindrical sleeve) that fits around the suppressor or firearm barrel. The rigid sleeve may be removable from the suppressor or barrel and therefore replaceable, or the rigid sleeve may be built into the suppressor or firearm; in such embodiments the sleeve may be openable for replacement or addition of silica fiber, fiber sheet, and/or powder. In various embodiments, a silica fiber powder may be incorporated into a liquid or gelatinous carrier and disposed within one or more chambers arranged around the suppressor and/or firearm barrel.

In various embodiments, the suppressor sleeve may incorporate or be mounted upon a positioning mechanism that enables the sleeve to be disposed around the suppressor and/or firearm muzzle while the firearm is being fired. In various embodiments, after the firearm is fired, and the sleeve minimizes heating of the suppressor and/or muzzle, the sleeve may be at least partially removed from the suppressor and/or muzzle, in order to, e.g., allow any remnant heat to escape to the ambient, thereby enabling more rapid cooling of the firearm (and/or component thereof). For example, the sleeve may slide out of place, off of the suppressor and/or muzzle, after firing, and slid back into place after a desired amount of time and/or after the firearm, component thereof, and/or suppressor has cooled to a desired temperature. In various embodiments, the positioning mechanism may include, consist essentially of, or consist of, for example, a frame with an outer slide on which the sleeve may be disposed.

In various embodiments of the invention, the structural matrix of the sound suppressor and/or one or more hollow chambers defined therewithin and/or a sleeve for a sound suppressor may include therewithin silica fiber powder. For example, in various embodiments, once a silica fiber mat is successfully electrospun, it may be processed into a powder or dust. For example, the electrospun mat may be "fragmented," i.e., fractured, cut, ground, milled (e.g., in a ball mill or other milling device), pulverized, or otherwise divided into small fragments that maintain a fibrous structure. As used herein, the term "fibrous fragments" (or "fibrous-mat fragments," or simply "fragments") refers to small particles, parts, or flakes of a fibrous mat having an average dimension larger (e.g., 5×, 10×, or even 100×) than the width of at least some of the fibers of the mat. In various embodiments, the average size of a fibrous fragment is in the range of approximately 20 μm to approximately 200 μm. Fibrous fragments may thus resemble microscopic-scale versions of the electrospun mat itself, e.g., intertwined collections of silica fibers, and thus typically are porous and have low densities. Thus, fibrous fragments may be contrasted with other types of micro-scale particles, such as the substantially spherical particles used in colloidal silica, which are each unitary, individual units or grains, rather than small collections of fibers. Various portions of a fibrous fragment (e.g., the edges) may have sharp and/or broken edges resulting from the fracturing process utilized to form the fragments from the electrospun mat. As utilized herein, the terms "silica fiber powder," "silica powder," "silica dust," and "fiber dust" include collections of particles generated via the fragmentation of electrospun fiber mats and/or fibers, and may include fibrous fragments and/or other powder particles resulting from such fragmentation. Such fragments and dust may be pressed or otherwise formed into sheets for incorporation into the sound suppressor and/or sleeve therefor.

Embodiments of the present invention may employ silica fibers, fragments thereof, and/or mixtures incorporating such fibers or fragments, and/or methods for fabricating such fibers or fragments detailed in U.S. patent application Ser. No. 15/934,599, filed on Mar. 23, 2018 (issued as U.S. Pat. No. 10,111,783), U.S. patent application Ser. No. 16/131,531, filed on Sep. 14, 2018, U.S. patent application Ser. No. 16/353,181, filed on Mar. 14, 2019, and U.S. patent application Ser. No. 16/367,313, filed on Mar. 28, 2019, the entire disclosure of each of which is incorporated by reference herein.

In an aspect, embodiments of the invention feature a sound suppressor for a firearm. The sound suppressor includes, consists essentially of, or consists of a cylindrical shell, an attachment mechanism, one or more chambers defined within the shell, and a sheet of silica fibers disposed within at least one of the chambers. The shell defines a hollow projectile path along a central longitudinal axis of the shell and has an outer surface and an inner surface. The attachment mechanism is disposed at one end of the shell and is configured to attach the shell to a muzzle of the firearm. The one or more chambers are fluidly coupled to the projectile path via one or more apertures defined in the inner surface of the shell.

Embodiments of the invention may include one or more of the following in any of a variety of combinations. At least a portion of the shell may include, consist essentially of, or consist of a matrix material. At least a portion of the matrix material may have, dispersed therewithin, a plurality of silica fibers, silica powder, and/or fibrous fragments of silica fibers. The matrix material may include, consist essentially of, or consist of a plastic and/or a metal. The sheet of silica fibers may extend partially or fully through the projectile path. The one or more chambers may include, consist essentially of, or consist of a plurality of chambers separated by baffles disposed within the shell, the apertures being disposed between the baffles. Fibers of the sheet of silica fibers may have diameters ranging from approximately 50 nm to approximately 5 μm. Fibers of the sheet of silica fibers may have diameters ranging from approximately 200 nm to approximately 1000 nm.

The sheet of silica fibers may be at least a portion of a non-woven mat of silica fibers formed by electrospinning a sol-gel. The sol-gel may be prepared with tetraethylorthosilicate (TEOS). The sol-gel may be produced from an initial sol containing 75% to 90% TEOS, 8% to 25% ethanol, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may include, consist essentially of, or consist of 70% to 90% TEOS by weight, 8% to 25% ethanol by weight, 1% to 10% water by weight, and the acid catalyst. The initial sol may include, consist essentially of, or consist of 75% to 85% by weight TEOS, 12% to 20% by weight ethanol, and about 2% to 5% by weight water. The initial sol may include, consist essentially of, or consist of about 80% by weight TEOS, about 17% by weight ethanol, and about 3% by weight water. The acid catalyst may include, consist essentially of, or consist of HCl. The initial sol may contain less than about 0.1% of the acid catalyst by weight. The initial sol may contain from 0.02% to 0.08% of the acid catalyst by weight. The initial sol may contain one or more reagents that alter one or more properties of the initial sol, the sol-gel, and/or the silica fibers.

Producing the sol-gel may include transitioning (or ripening) the initial sol for at least 2 days under conditions where humidity is within the range of about 40% to about 80%, and the temperature is within the range of 50° F. to 90° F. The initial sol may be allowed to transition for at least 3 days, at least 4 days, at least 5 days, at least 6 days, or at least 7 days. The initial sol may be allowed to transition for 2 days to 10 days, and for 2 days to 7 days in some embodiments. The sol-gel may be electrospun when the weight is at from 10% to 60% of the starting weight of the initial sol or sol-gel before ripening (transitioning). The sol-gel may be electrospun when the weight is at from 10% to 40% of the starting weight of the initial sol or sol-gel before ripening (transitioning). The sol-gel may be electrospun when the weight is at from 20% to 40% of the starting weight of the initial sol or sol-gel before ripening (transitioning). The sol-gel may be electrospun when the production of ethylene vapor is 10% to 20% relative to the peak production of ethylene vapors during ripening (transitioning) of the initial sol or sol-gel before ripening. The sol-gel may be electrospun when the production of ethylene vapor therefrom is 10% to 40% relative to the initial sol or sol-gel before ripening (transitioning).

At least a portion of the sheet may be formed by a process including, consisting essentially of, or consisting of (i) electrospinning a sol-gel to form a mat of silica fibers, and (ii) fragmenting the mat to form silica fiber powder. The process of forming the at least a portion of the sheet may include pressing or molding at least a portion of the silica fiber powder. The silica fiber powder may include, consist essentially of, or consist of a plurality of fibrous fragments each composed of a plurality of silica fibers or portions thereof. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm.

In another aspect, embodiments of the invention feature a firearm configured for sound suppression. The firearm includes, consists essentially of, or consists of a housing configured to receive ammunition therein, a hollow cylindrical barrel extending from the housing, a firing mechanism configured to control firing of the ammunition, through the barrel, from the firearm, and a sound suppressor coupled to the barrel and having one or more sheets of silica fibers therein.

Embodiments of the invention may include one or more of the following in any of a variety of combinations. The sound suppressor may include, consist essentially of, or consist of a cylindrical shell and one or more chambers defined within the shell. The shell may define a hollow projectile path along a central longitudinal axis of the shell. The shell may have an outer surface and an inner surface. The projectile path may be aligned with a central bore of the barrel. The one or more chambers may be fluidly coupled to the projectile path via one or more apertures defined in the inner surface of the shell. The one or more sheets of silica fibers may be disposed within at least one of the chambers. At least a portion of the shell may include, consist essentially of, or consist of a matrix material. At least a portion of the matrix material may have, dispersed therewithin, a plurality of silica fibers, silica powder, and/or fibrous fragments of silica fibers. The matrix material may include, consist essentially of, or consist of a plastic and/or a metal. At least one said sheet of silica fibers may extend partially or fully through the projectile path. The one or more chambers may include, consist essentially of, or consist of a plurality of chambers separated by baffles disposed within the shell, the apertures being disposed between the baffles. Fibers of at least one said sheet of silica fibers may have diameters ranging from approximately 50 nm to approximately 5 μm. Fibers of at least one said sheet of silica fibers may have diameters ranging from approximately 200 nm to approximately 1000 nm. At least one said sheet of silica fibers may be at least a portion of a non-woven mat of silica fibers formed by electrospinning a sol-gel.

In yet another aspect, embodiments of the invention feature a sound suppressor for a firearm. The sound suppressor includes, consists essentially of, or consists of a cylindrical shell, an attachment mechanism, and one or more chambers defined within the shell. The shell defines a hollow projectile path along a central longitudinal axis of the shell and has an outer surface and an inner surface. The attachment mechanism is disposed at one end of the shell and is configured to attach the shell to a muzzle of the firearm. The one or more chambers are fluidly coupled to the projectile path via one or more apertures defined in the inner surface of the shell. At least a portion of the shell includes, consists essentially of, or consists of a matrix material and, dispersed therewithin, a plurality of silica fibers, silica powder, and/or fibrous fragments of silica fibers.

Embodiments of the invention may include one or more of the following in any of a variety of combinations. The matrix material may include, consist essentially of, or consist of a plastic and/or a metal. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm.

The silica fibers, silica powder, and/or fibrous fragments may be portions of a non-woven mat of silica fibers formed by electrospinning a sol-gel. The silica powder and/or fibrous fragments may be formed by a process including, consisting essentially of, or consisting of (i) electrospinning a sol-gel to form a mat of silica fibers, and (ii) fragmenting the mat. The sol-gel may be prepared with tetraethylorthosilicate (TEOS). The sol-gel may be produced from an initial sol containing 75% to 90% TEOS, 8% to 25% ethanol, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may include, consist essentially of, or consist of 70% to 90% TEOS by weight, 8% to 25% ethanol by weight, 1% to 10% water by weight, and the acid catalyst. The initial sol may include, consist essentially of, or consist of 75% to 85% by weight TEOS, 12% to 20% by weight ethanol, and about 2% to 5% by weight water. The initial sol may include, consist essentially of, or consist of about 80% by weight TEOS, about 17% by weight ethanol, and about 3% by weight water. The acid catalyst may include, consist essentially of, or consist of HCl. The initial sol may contain less than about 0.1% of the acid catalyst by weight. The initial sol may contain from 0.02% to 0.08% of the acid catalyst by weight. The initial sol may contain one or more reagents that alter one or more properties of the initial sol, the sol-gel, and/or the silica fibers.

Producing the sol-gel may include transitioning (or ripening) the initial sol for at least 2 days under conditions where humidity is within the range of about 40% to about 80%, and the temperature is within the range of 50° F. to 90° F. The initial sol may be allowed to transition for at least 3 days, at least 4 days, at least 5 days, at least 6 days, or at least 7 days. The initial sol may be allowed to transition for 2 days to 10 days, and for 2 days to 7 days in some embodiments. The sol-gel may be electrospun when the weight is at from 10% to 60% of the starting weight of the initial sol or sol-gel before ripening (transitioning). The sol-gel may be electrospun when the weight is at from 10% to 40% of the starting weight of the initial sol or sol-gel before ripening (transitioning). The sol-gel may be electrospun when the weight is at from 20% to 40% of the starting weight of the initial sol or sol-gel before ripening (transitioning). The sol-gel may be electrospun when the production of ethylene vapor is 10% to 20% relative to the peak production of ethylene vapors during ripening (transitioning) of the initial sol or sol-gel before ripening. The sol-gel may be electrospun when the production of ethylene vapor therefrom is 10% to 40% relative to the initial sol or sol-gel before ripening (transitioning).

In another aspect, embodiments of the invention feature a firearm configured for sound suppression. The firearm includes, consists essentially of, or consists of a housing configured to receive ammunition therein, a hollow cylindrical barrel extending from the housing, a firing mechanism configured to control firing of the ammunition, through the barrel, from the firearm, and a sound suppressor coupled to the barrel. At least a portion of the sound suppressor includes, consists essentially of, or consists of a matrix material and, dispersed therewithin, a plurality of silica fibers, silica powder, and/or fibrous fragments of silica fibers.

Embodiments of the invention may include one or more of the following in any of a variety of combinations. The sound suppressor may include, consist essentially of, or consist of a cylindrical shell and one or more chambers defined within the shell. The shell may define a hollow projectile path along a central longitudinal axis of the shell. The shell may have an outer surface and an inner surface. The projectile path may be aligned with a central bore of the barrel. The one or more chambers may be fluidly coupled to the projectile path via one or more apertures defined in the inner surface of the shell. At least a portion of the shell may include, consist essentially of, or consist of the matrix material having the plurality of silica fibers, silica powder, and/or fibrous fragments of silica fibers dispersed therein. The matrix material may include, consist essentially of, or consist of a plastic and/or a metal. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm. The silica fibers, silica powder, and/or fibrous fragments may be portions of a non-woven mat of silica fibers formed by electrospinning a sol-gel.

In yet another aspect, embodiments of the invention feature a method of fabricating a sound suppressor for a firearm. A cylindrical shell is provided. The shell defines a hollow projectile path along a central longitudinal axis of the shell and has (i) an outer surface, (ii) an inner surface, (iii) disposed at one end, an attachment mechanism configured to attach the shell to a muzzle of the firearm, and (iv) defined within the shell, one or more chambers fluidly coupled to the projectile path via one or more apertures defined in the inner surface of the shell. One or more sheets of silica fibers are provided. At least a portion of one of the sheets of silica fibers is placed within at least one of the chambers.

Embodiments of the invention may include one or more of the following in any of a variety of combinations. Providing the one or more sheets of silica fibers may include, consist essentially of, or consist of electrospinning a sol-gel. The sol-gel may be prepared with tetraethylorthosilicate (TEOS). The sol-gel may be produced from an initial sol containing 75% to 90% TEOS, 8% to 25% ethanol, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may include, consist essentially of, or consist of 70% to 90% TEOS by weight, 8% to 25% ethanol by weight, 1% to 10% water by weight, and the acid catalyst. The initial sol may include, consist essentially of, or consist of 75% to 85% by weight TEOS, 12% to 20% by weight ethanol, and about 2% to 5% by weight water. The initial sol may include, consist essentially of, or consist of about 80% by weight TEOS, about 17% by weight ethanol, and about 3% by weight water. The acid catalyst may include, consist essentially of, or consist of HCl. The initial sol may contain less than about 0.1% of the acid catalyst by weight. The initial sol may contain from 0.02% to 0.08% of the acid catalyst by weight. The initial sol may contain one or more reagents that alter one or more properties of the initial sol, the sol-gel, and/or the silica fibers.

Producing the sol-gel may include transitioning (or ripening) the initial sol for at least 2 days under conditions where humidity is within the range of about 40% to about 80%, and the temperature is within the range of 50° F. to 90° F. The initial sol may be allowed to transition for at least 3 days, at least 4 days, at least 5 days, at least 6 days, or at least 7 days. The initial sol may be allowed to transition for 2 days to 10 days, and for 2 days to 7 days in some embodiments. The sol-gel may be electrospun when the weight is at from 10% to 60% of the starting weight of the initial sol or sol-gel before ripening (transitioning). The sol-gel may be electrospun when the weight is at from 10% to 40% of the starting weight of the initial sol or sol-gel before ripening (transitioning). The sol-gel may be electrospun when the weight is at from 20% to 40% of the starting weight of the initial sol or sol-gel before ripening (transitioning). The sol-gel may be electrospun when the production of ethylene vapor is 10% to 20% relative to the peak production of ethylene vapors during ripening (transitioning) of the initial sol or sol-gel before ripening. The sol-gel may be electrospun when the production of ethylene vapor therefrom is 10% to 40% relative to the initial sol or sol-gel before ripening (transitioning).

Providing the one or more sheets of silica fibers may include, consist essentially of, or consist of electrospinning a sol-gel to form a mat of silica fibers, (ii) fragmenting the mat to form silica fiber powder, and (iii) pressing or molding at least a portion of the silica fiber powder. The silica fiber powder may include, consist essentially of, or consist of a plurality of fibrous fragments each composed of a plurality of silica fibers or portions thereof. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm.

The at least a portion of said sheet of silica fibers may extend partially or fully through the projectile path. The one or more chambers may include, consist essentially of, or consist of a plurality of chambers separated by baffles disposed within the shell, the apertures being disposed between the baffles. The shell may be attached to the muzzle of the firearm using the attachment mechanism. The attachment mechanism may mate with a complimentary attachment mechanism disposed on or provided as a part of the muzzle. The firearm may be loaded with ammunition. The firearm may be fired, and sound and/or heat associated with the firing may be suppressed by the sound suppressor.

In another aspect, embodiments of the invention feature a method of fabricating a sound suppressor for a firearm. A compartmented sheet defining a plurality of compartments therein is provided. At least a portion of a sheet of silica fibers is placed in at least one of the compartments. At least a portion of the sheet is shaped into a hollow tube defining therewithin a hollow projectile path along a central longitudinal axis of the tube, the one or more compartments being fluidly coupled to the projectile path.

Embodiments of the invention may include one or more of the following in any of a variety of combinations. The tube may be placed within a hollow envelope. The envelope may include an attachment mechanism configured to attach the envelope to a muzzle of the firearm. The envelope may be attached to the muzzle of the firearm using the attachment mechanism. The firearm may be loaded with ammunition. The firearm may be fired, and sound and/or heat associated with the firing may be suppressed by the sound suppressor. The compartments of the compartmented sheet may extend through top and bottom surfaces of the compartmented sheet. The compartmented sheet may include a solid bottom surface. The bottom surface may form at least a portion of an outer surface of the tube after the compartmented sheet is shaped.

Providing the sheet of silica fibers may include, consist essentially of, or consist of electrospinning a sol-gel. The sol-gel may be prepared with tetraethylorthosilicate (TEOS). The sol-gel may be produced from an initial sol containing 75% to 90% TEOS, 8% to 25% ethanol, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may include, consist essentially of, or consist of 70% to 90% TEOS by weight, 8% to 25% ethanol by weight, 1% to 10% water by weight, and the acid catalyst. The initial sol may include, consist essentially of, or consist of 75% to 85% by weight TEOS, 12% to 20% by weight ethanol, and about 2% to 5% by weight water. The initial sol may include, consist essentially of, or consist of about 80% by weight TEOS, about 17% by weight ethanol, and about 3% by weight water. The acid catalyst may include, consist essentially of, or consist of HCl. The initial sol may contain less than about 0.1% of the acid catalyst by weight. The initial sol may contain from 0.02% to 0.08% of the acid catalyst by weight. The initial sol may contain one or more reagents that alter one or more properties of the initial sol, the sol-gel, and/or the silica fibers.

Producing the sol-gel may include transitioning (or ripening) the initial sol for at least 2 days under conditions where humidity is within the range of about 40% to about 80%, and the temperature is within the range of 50° F. to 90° F. The initial sol may be allowed to transition for at least 3 days, at least 4 days, at least 5 days, at least 6 days, or at least 7 days. The initial sol may be allowed to transition for 2 days to 10 days, and for 2 days to 7 days in some embodiments. The sol-gel may be electrospun when the weight is at from 10% to 60% of the starting weight of the initial sol or sol-gel before ripening (transitioning). The sol-gel may be electrospun when the weight is at from 10% to 40% of the starting weight of the initial sol or sol-gel before ripening (transitioning). The sol-gel may be electrospun when the weight is at from 20% to 40% of the starting weight of the initial sol or sol-gel before ripening (transitioning). The sol-gel may be electrospun when the production of ethylene vapor is 10% to 20% relative to the peak production of ethylene vapors during ripening (transitioning) of the initial sol or sol-gel before ripening. The sol-gel may be electrospun when the production of ethylene vapor therefrom is 10% to 40% relative to the initial sol or sol-gel before ripening (transitioning).

Providing the sheet of silica fibers may include, consist essentially of, or consist of electrospinning a sol-gel to form a mat of silica fibers, (ii) fragmenting the mat to form silica fiber powder, and (iii) pressing or molding at least a portion of the silica fiber powder. The silica fiber powder may include, consist essentially of, or consist of a plurality of fibrous fragments each composed of a plurality of silica fibers or portions thereof. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm.

In yet another aspect, embodiments of the invention feature a sleeved sound suppressor for a firearm. The sleeved sound suppressor includes, consists essentially of, or consists of a cylindrical shell, an attachment mechanism disposed at one end of the shell, one or more chambers defined within the shell, and a sleeve. The shell defines a hollow projectile path along a central longitudinal axis of the shell and has an outer surface and an inner surface. The attachment mechanism is configured to attach the shell to a muzzle of the firearm. The one or more chambers are fluidly coupled to the projectile path via one or more apertures defined in the inner surface of the shell. The sleeve is disposed around at least a portion of the outer surface of the shell. The sleeve includes, consists essentially of, or consists of a plurality of silica fibers, silica powder, and/or fibrous fragments of silica fibers.

Embodiments of the invention may include one or more of the following in any of a variety of combinations. The sleeve may include, consist essentially of, or consist of a matrix material. The silica fibers, silica powder, and/or fibrous fragments of silica fibers may be disposed within and/or on the matrix material. The matrix material may include, consist essentially of, or consist of a liquid and/or a gel. The matrix material may include, consist essentially of, or consist of an adhesive tape. The sleeve may be removable from the at least a portion of the outer surface of the shell. The sleeve may include an at least partially enclosed volume disposed (e.g., permanently disposed or removably disposed) around the at least a portion of the outer surface of the shell. The plurality of silica fibers, silica powder, and/or fibrous fragments of silica fibers may be disposed within the at least partially enclosed volume. The shell may include, consist essentially of, or consist of a matrix material and, dispersed therewithin, a plurality of silica fibers, silica powder, and/or fibrous fragments of silica fibers. The matrix material may include, consist essentially of, or consist of a plastic and/or a metal.

In another aspect, embodiments of the invention feature a sleeve for a firearm sound suppressor. The sleeve includes, consists essentially of, or consists of a tubular construct containing therewithin or including, consisting essentially of, or consisting of, at least in part, a plurality of silica fibers, silica powder, and/or fibrous fragments of silica fibers. The tubular construct defines a hollow central bore and is configured to receive at least a portion of the sound suppressor within the hollow central bore.

Embodiments of the invention may include one or more of the following in any of a variety of combinations. The tubular construct may define an annular hollow cavity containing therewithin the plurality of silica fibers, silica powder, and/or fibrous fragments of silica fibers. The cavity may contain a matrix material therewithin. The matrix material may include, consist essentially of, or consist of a liquid and/or a gel. An inner surface of the tubular construct may be adhesive.

In yet another aspect, embodiments of the invention feature a firearm configured for suppression of sound and/or heat. The firearm includes, consists essentially of, or consists of a housing configured to receive ammunition therein, a hollow cylindrical barrel extending from the housing, a firing mechanism configured to control firing of the ammunition, through the barrel, from the firearm, and a sleeved sound suppressor coupled to the barrel. The sleeved sound suppressor includes, consists essentially of, or consists of a cylindrical shell, one or more chambers defined within the shell, and a sleeve. The shell defines a hollow projectile path along a central longitudinal axis of the shell and has an outer surface and an inner surface. The projectile path is aligned with a central bore of the barrel. The one or more chambers are fluidly coupled to the projectile path via one or more apertures defined in the inner surface of the shell. The sleeve is disposed around at least a portion of the outer surface of the shell. The sleeve includes, consists essentially of, or consists of a plurality of silica fibers, silica powder, and/or fibrous fragments of silica fibers.

Embodiments of the invention may include one or more of the following in any of a variety of combinations. The sleeve may include, consist essentially of, or consist of a matrix material. The silica fibers, silica powder, and/or fibrous fragments of silica fibers may be disposed within and/or on the matrix material. The matrix material may include, consist essentially of, or consist of a liquid and/or a gel. The matrix material may include, consist essentially of, or consist of an adhesive tape. The sleeve may be removable from the at least a portion of the outer surface of the shell. The sleeve may include, consist essentially of, or consist of an at least partially enclosed volume disposed (e.g., permanently disposed or removably disposed) around the at least a portion of the outer surface of the shell. The plurality of silica fibers, silica powder, and/or fibrous fragments of silica fibers may be disposed within the at least partially enclosed volume. The shell may include, consist essentially of, or consist of a matrix material and, dispersed therewithin, a plurality of silica fibers, silica powder, and/or fibrous fragments of silica fibers. The matrix material may include, consist essentially of, or consist of a plastic and/or a metal.

In another aspect, embodiments of the invention feature a firearm configured for suppression of sound and/or heat. The firearm includes, consists essentially of, or consists of a housing configured to receive ammunition therein, a hollow cylindrical barrel extending from the housing, a firing mechanism configured to control firing of the ammunition, through the barrel, from the firearm, and a sleeve disposed around at least a portion of the barrel. The sleeve includes, consists essentially of, or consists of a plurality of silica fibers, silica powder, and/or fibrous fragments of silica fibers.

Embodiments of the invention may include one or more of the following in any of a variety of combinations. The sleeve may include, consist essentially of, or consist of a matrix material. The silica fibers, silica powder, and/or fibrous fragments of silica fibers may be disposed within and/or on the matrix material. The matrix material may include, consist essentially of, or consist of a liquid and/or a gel. The matrix material may include, consist essentially of, or consist of an adhesive tape. The sleeve may be removable from the at least a portion of the barrel. The sleeve may include, consist essentially of, or consist of an at least partially enclosed volume disposed (e.g., permanently disposed or removably disposed) around the at least a portion of the barrel. The plurality of silica fibers, silica powder, and/or fibrous fragments of silica fibers may be disposed within the at least partially enclosed volume.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and may exist in various combinations and permutations. As used herein, the terms "approximately," "about," and "substantially" mean±10%, and in some embodiments, ±5%. The term "consists essentially of" means excluding other materials that contribute to function, unless otherwise defined herein. Nonetheless, such other materials may be present, collectively or individually, in trace amounts. Unless otherwise indicated, sound suppressors, suppressor sleeves, materials, mixtures, regions, and other structures described herein may incorporate unintentional impurities.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1A:
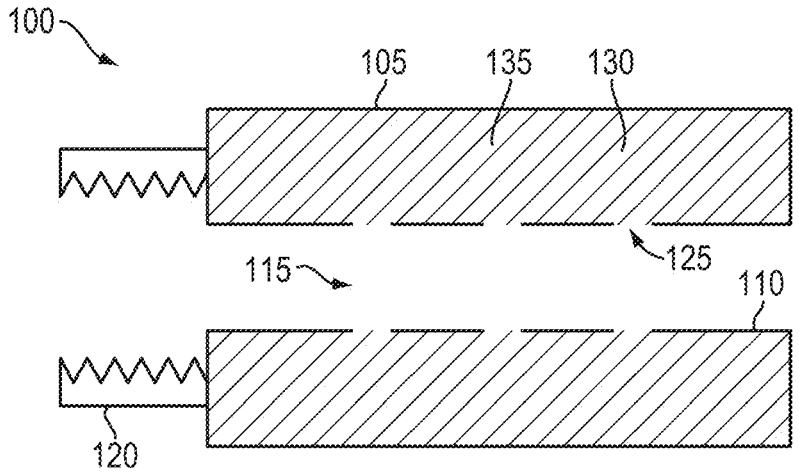
FIG. 1A is a cross-sectional schematic of a sound suppressor in accordance with embodiments of the invention.

In accordance with various embodiments of the present invention, silica fibers and/or powder formed therefrom are utilized as packing material, wipe material, and/or as a portion of the structural matrix for firearm sound suppressors. For example, sheets or mats of silica fibers may be utilized to at least partially fill hollow chambers within the sound suppressor. In addition or instead, the silica fibers and/or powder may be mixed into the main structural material of the sound suppressor (e.g., one or more plastics and/or metals) to form a composite material with superior characteristics. The silica fibers themselves may be produced from a gelatinous material that is electrospun to form a fiber mat. The mat itself (or a portion thereof) may be utilized within the sound suppressor, with or without additional processing (e.g., pressing and/or incorporation of a liquid or gelatinous material therewithin). In various embodiments, the mat is fragmented into a powder or dust, which may include, consist essentially of, or consist of fibrous fragments. The powder may be utilized within the chambers of the sound suppressor and/or within the composite structural matrix. Similarly, the silica fibers and/or powder may be utilized within and/or as protective, heat-resistant sleeves configured to be disposed around all or a portion of a sound suppressor and/or a portion of the firearm itself (e.g., all or a portion of the barrel).

In some embodiments, silica fibers and/or fiber mats are electrospun from a gelatinous material. For example, the silica fibers and/or fiber mats may be prepared by electrospinning a sol-gel, which may be prepared with a silicon alkoxide reagent, such as tetraethyl ortho silicate (TEOS), alcohol solvent, and an acid catalyst.

In some embodiments, the sol-gel for preparing the silica fiber composition is prepared by a method that includes preparing a first mixture containing an alcohol solvent, a silicon alkoxide reagent such as tetraethylorthosilicate (TEOS); preparing a second mixture containing an alcohol solvent, water, and an acid catalyst; fully titrating the second mixture into the first mixture; and processing (ripening) the combined mixture to form a gel for electrospinning. In some embodiments, the silicon alkoxide reagent is TEOS. Alternative silicon alkoxide reagents include those with the formula $Si(OR)_4$, where R is from 1 to 6, and preferably 1, 2, or 3.

In some embodiments, the sol comprises, consists essentially of, or consists of about 70% to about 90% by weight silicon alkoxide (e.g., TEOS), about 5% to about 25% by weight alcohol solvent (e.g., anhydrous ethanol), an acid catalyst (e.g., less than about 0.1% by weight when using HCl) and water. Any sol or sol-gel described herein may include the balance water (i.e., water may constitute any amount of the sol or sol-gel that is otherwise unspecified). Any sol or sol-gel described herein may optionally contain one or more reagents or additives that may or do alter one or more properties of the sol, the sol-gel, and/or the silica fibers (and/or powder prepared therefrom). Such reagents may include, but are not limited to, for example, polymers and polymeric solutions, inert reagents, alcohols, organic and/or aqueous solvents, organic salts, inorganic salts, metals, metal oxides, metal nitrides, metal oxynitrides, carbon (e.g., graphene, graphite, amorphous carbon, fullerenes, etc.), etc.

In some embodiments, the sol contains 70% to 90% tetraethyl orthosilicate (TEOS) by weight, 8% to 25% ethanol by weight, 1% to 10% water by weight, and an acid catalyst. In some embodiments, the sol contains 75% to 85% by weight TEOS, 12% to 20% by weight ethanol, and about 2% to 5% by weight water. An exemplary sol contains about 80% by weight TEOS, about 17% by weight ethanol, and about 3% by weight water. In some embodiments, the acid catalyst is HCl. For example, the sol may contain less than about 0.1% HCl by weight. For example, the sol may contain from 0.02% to 0.08% HCl by weight. In various embodiments, the sol does not contain an organic polymer, or other substantial reagents, such that the fiber composition will be substantially pure $SiO_2$. In various embodiments, the sol does not include inorganic salts (e.g., sodium chloride, lithium chloride, potassium chloride, magnesium chloride, calcium chloride, and/or barium chloride), nor are, in various embodiments, inorganic salts mixed with other components of the sol or into the sol itself. In various embodiments, the fiber composition does not include metals or metal oxides (e.g., $TiO_2$ or $ZrO_2$). In various embodiments, the fiber composition consists essentially of $SiO_2$, i.e., contains only $SiO_2$ and unintentional impurities, and, in some embodiments, species and/or complexes resulting from the incomplete conversion of the sol to $SiO_2$ (e.g., water and/or chemical groups such as ethoxy groups, silanol groups, hydroxyl groups, etc.). In various embodiments, additives may be incorporated onto silica fibers and or powder prepared therefrom after the electrospinning process.

In some embodiments, the alcohol solvent is an anhydrous denatured ethanol, or in some embodiments, methanol, propanol, butanol or any other suitable alcohol solvent. The first mixture may be agitated, for example, using a magnetic stirrer, vibration platform or table, or other agitation means. The second mixture contains an alcohol solvent, water, and an acid catalyst. The alcohol solvent may be an anhydrous denatured alcohol, or may be methanol, propanol, butanol or any other suitably provided alcohol solvent. Water may be distilled water or deionized water. Enough acid catalyst is added to the mixture to aid in the reaction. This acid catalyst may be hydrochloric acid, or may be sulfuric acid or other suitable acid catalyst. The second mixture may be agitated, for example, magnetic stirrer, vibration platform or table, or other agitation means. In some embodiments, the first mixture (or sol) and the second mixture (or sol) are created without the use of direct heat (i.e., heat applied via extrinsic means such as a hot plate or other heat source).

According to various embodiments, the first mixture and the second mixture are combined by dripping or titrating the second mixture into the first mixture, preferably with agitation. The combined mixture is then further processed by allowing the sol to ripen in a controlled environment until a substantial portion of the alcohol solvent has evaporated to create a sol-gel suitable for electrospinning. For example, the controlled environment may include an enclosure with at least one vent and optionally a fan to draw gases away from the mixture, and which may involve controlled conditions in terms of humidity, temperature, and optionally barometric pressure. For example, the humidity may be controlled (e.g., via use of conventional humidifiers and/or dehumidifiers) within the range of about 30% to about 90%, such as from about 40% to about 80%, or in some embodiments, from about 50% to about 80%, or from about 50% to about 70% (e.g., about 55%, or about 60%, or about 65%). Some humidity may be helpful to slow evaporation of solvent, and thereby lengthen the window for successful electrospinning. In some embodiments, the temperature is in the range of from about 50° F. to about 90° F., such as from about 60° F. to about 80° F., or from about 65° F. to about 75° F. In various embodiments, the sol is not exposed to heat over 150° F. or heat over 100° F., so as to avoid accelerating the transition. In some embodiments, barometric pressure is optionally controlled (e.g., using a low pressure vacuum source such as a pump or a fan). By controlling the environmental conditions during ripening, the time period during which the gel may be electrospun may be lengthened; this time period may be a small window of only several minutes if the ripening process is too accelerated, such as with direct heat. When ripening the sol at a constant humidity of about 55% and temperature of about 72° F., the sol will ripen (gelatinize) in a few days, and the window for successful electrospinning may be expanded to at least several hours, and in some embodiments several days. In various embodiments, the ripening process takes at least 2 days, or at least 3 days in some embodiments. However, in various embodiments the ripening does not take more than 10 days, or more than 7 days. In some embodiments, the ripening process takes from 2 to 10 days, or from 2 to 7 days, or from 2 to 5 days, or from 2 to 4 days (e.g., about 2, about 3, or about 4 days). In various embodiments, the sol-gel is spinnable well before it transitions into a more solidified, non-flowable mass.

The enclosure space for ripening the sol-gel may include a vent on at least one surface for exhausting gases from within the enclosure, and optionally the vent may include a fan for exhausting gases produced during the ripening process. The enclosure space may optionally include a heating source (e.g., one or more heating elements, for example resistive heating elements) for providing a nominal amount of heat within the enclosure space, to maintain a preferred temperature. In some embodiments, a source of humidity (e.g., an open container of water or other aqueous, water-based liquid) is provided within the enclosure environment to adjust the humidity to a desired range or value. The enclosure may further include one or more environmental monitors, such as a temperature reading device (e.g., a thermometer, thermocouple, or other temperature sensor) and/or a humidity reading device (e.g., a hygrometer or other humidity sensor).

In some embodiments, the sol-gel is electrospun after a ripening process of at least 2 days, or at least 36 hours, or at least 3 days, or at least 4 days, or at least 5 days at the controlled environmental conditions (but in various embodiments, not more than 10 days or not more than 7 days under the controlled environmental conditions). By slowing the ripening process, the ideal time to spin the fibers can be identified. The weight of the sol-gel may be used as an indicator of when the sol-gel is at or near the ideal time to electrospin. Without intending to be bound by theory, it is believed that the viscosity of the sol-gel is a poor determinant for identifying the optimal time for electrospinning. For example, in various embodiments, the sol-gel is from about 10% to about 60% of the original weight of the sol (based on loss of alcohol solvent during transitioning). In some embodiments, the sol-gel is from 15 to 50% of the original weight of the sol, or in the range of about 20 to about 40% of the original weight of the sol.

In some embodiments, the sol-gel is ripened for at least 2 days, or at least 36 hours, or at least 3 days, or at least 4 days, or at least 5 days, and is electrospun when the ethylene vapors produced by the composition are between about 10% and about 40% of the vapors produced by the starting sol, such as in the range of about 10% and about 25%, or in the range of about 10% to about 20%. Ethylene is a colorless flammable gas with a faint sweet and musky odor (which is clearly evident as solvent evaporation slows). Ethylene is produced by the reaction of ethanol and acid. Ethylene may optionally be monitored in the vapors using a conventional ethylene monitor. In other embodiments, gases produced by the sol during the sol ripening process are monitored to determine a suitable or optimal time for electrospinning. Gas profiles may be monitored using gas chromatography.

In various embodiments, the sol-gel may be ripened for a shorter period of time, as long as the sol-gel remains spinnable via electrospinning. The resulting silica fiber mat or collection of fibers may in some cases be more brittle after ripening for a shorter time period, but such brittleness may not prevent the fragmenting of the fibers and production of powder therefrom. In various embodiments, silica fiber powder utilized in the sound suppressor (e.g., as a portion of the structural matrix) may be produced from silica fibers or fiber mats electrospun after ripening for less time than silica fibers or mats utilized within the sound suppressor in mat or sheet form. For example, silica fiber powder utilized in the sound suppressor may be produced from silica fibers or fiber mats electrospun after ripening for less than 2 days or less than 1 day (but, in some embodiments, at least 1 hour, at least 2 hours, at least 4 hours, at least 6 hours, or at least 12 hours).

The processing of the sol-gel mixture may require stirring or other agitation of the mixtures at various intervals or continuously due to the development of silicone dioxide crystalline material on the top surface of the mixtures. This development of crystalline material on the top surface slows the processing time and it is believed that the crystalline material seals off exposure of the mixture to the gaseous vacuum provided within the enclosure space. In some embodiments, any solid crystalline material is removed from the mixture.

Upon completion of the sol-gel process, the sol-gel is then electrospun using any known technique. The sol or sol-gel may be preserved (e.g., frozen or refrigerated) if needed (and such time generally will not apply to the time for ripening). An exemplary process for electrospinning the sol-gel is described in Choi, Sung-Seen, et al., *Silica nanofibers from electrospinning/sol-gel process, Journal of Materials Science Letters* 22, 2003, 891-893, which is hereby incorporated by reference in its entirety. Exemplary processes for electrospinning are further disclosed in U.S. Pat. No. 8,088,965, which is hereby incorporated by reference in its entirety.

In an exemplary electrospinning technique, the sol-gel is placed into one or more syringe pumps that are fluidly coupled to one or more spinnerets. The spinnerets are connected to a high-voltage (e.g., 5 kV to 50 kV) source and are external to and face toward a grounded collector drum. The drum rotates during spinning, typically along an axis of rotation approximately perpendicular to the spinning direction extending from the spinnerets to the drum. As the sol-gel is supplied to the spinnerets from the syringe pumps (or other holding tank), the high voltage between the spinnerets and the drum forms charged liquid jets that are deposited on the drum as small entangled fibers. As the drum rotates and electrospinning continues, a fibrous mat of silica fibers is formed around the circumference of the drum. In various embodiments, the spinnerets and syringe pump(s) may be disposed on a movable platform that is movable parallel to the length of the drum. In this manner, the length along the drum of the resulting fiber mat may be increased without increasing the number of spinnerets. The diameter of the drum may also be increased to increase the areal size of the electrospun mat. The thickness of the mat may be largely dependent upon the amount of sol-gel used for spinning and thus the amount of electrospinning time. For example, the mat may have a thickness of greater than about ⅛ inch, or greater than about ¼ inch, or greater than about ⅓ inch, or greater than about ½ inch.

After completion of the electrospinning process, the resulting mat is removed from the drum. For example, the mat may be cut and peeled away from the drum in one or more pieces. The mat may then be fragmented to form a powder. In various embodiments, the powder includes, consists essentially of, or consists of small fibrous fragments that are each intertwined collections of silica fibers, rather than unitary solid particles. In some embodiments, the electrospun mat may be fractured, cut, ground, milled, or otherwise divided into small fragments that maintain a fibrous structure. In some embodiments, the mat (or one or more portions thereof) is rubbed through one or more screens or sieves, and the mesh size of the screen determines, at least in part, the size of the resulting fibrous fragments or powder or dust produced from the electrospun mat. For example, the mat or mat portions may be rubbed through a succession of two or more screens having decreasing mesh sizes (e.g., screens having mesh numbers of 100, 200, 300, or even 400), in order to produce a powder or dust or collection of fibrous fragments having the desired sizes. In various embodiments, the powder or dust may include, consist essentially of, or consist of a plurality of fractured fiber portions having sizes mainly within the desired size range.

After fabrication of the fibrous fragments having the desired size, the powder may be mixed into materials utilized for shaping or molding into a sound suppressor (or a portion thereof) or into a sleeve for a sound suppressor, such as metals, epoxies, urethanes, thermoplastics, thermosetting plastics, resins, etc., thereby forming a composite material having additional beneficial characteristics. In various embodiments, the powder is added into the material at concentrations ranging from approximately 0.5 gram per gallon to approximately 10 grams per gallon. In various embodiments, the fibrous fragments are hydrophobic, and the composition is agitated in order to disperse the fragments therewithin after mixing and/or prior to molding of the composition into the desired shape. Mixtures may be molded, pressed, extruded, or otherwise shaped and cured (if necessary, e.g., before and/or after shaping) with the powder embedded therewithin. In various embodiments, the powder is inert to the composition in which they are mixed and do not react chemically therewith. The resulting sound suppressor or sleeve therefor may exhibit increased thermal resistance, increased mechanical strength, and/or increased durability.

In various embodiments of the invention, the electrospun mat of silica fibers itself (or one or more portions thereof) is disposed within the sound suppressor (e.g., within one or more hollow chambers therewithin) and/or sleeve therefor without further fragmentation into fragments. The fibers may impart improved thermal resistance and sound-suppression characteristics.

In various embodiments, when the powder or fibrous fragments are mixed into a liquid or gelatinous composition, the fibers or portions thereof constituting the fragments may separate from each other, resulting in a dispersion of individual (or small numbers of) silica fibers within the composition prior to solidification, in embodiments in which solidification occurs. (In various embodiments, a mixture or suspension of silica fibers and/or silica powder may remain in liquid or gel form, for example in one or more enclosed compartments.) Such fibers may have individual lengths no more than approximately 10×, no more than 5×, or no more than 2× the size of the fragments. In other embodiments, the fibrous fragments may remain substantially intact within the composition.

FIG. 1A is a cross-sectional schematic of a sound suppressor 100 in accordance with embodiments of the invention. As shown, the sound suppressor 100 has a generally cylindrical shape with an outer surface 105 and an inner surface 110 that surrounds a hollow projectile path (or "bore") 115. The projectile path 115 extends through the entire sound suppressor 100 along its central longitudinal axis and is sized to enable the passage therethrough of bullets or other ammunition discharged into the sound suppressor 100. In various embodiments, the sound suppressor 100 is configured for reversible attachment to the muzzle of a firearm via, for example, attachment mechanism 120. In various embodiments, the attachment mechanism 120 may include, consist essentially of, or consist of a threaded cylinder configured to interface with complementary threads on the muzzle of the firearm, as shown in FIG. 1A. (The attachment mechanism 120 is omitted from the remaining figures for clarity.) In various embodiments of the invention, the inner surface 110 of the sound suppressor 100 defines one or more apertures 125 therethrough, thereby enabling access to one or more hollow chambers 130 disposed between the outer surface 105 and the inner surface 110. As shown in the schematic cut-away view of FIG. 1B, the apertures 125 may be circular in shape, although in other embodiments of the invention the apertures 125 may have other shapes (e.g., squares, rectangles, hexagons, slots, etc.). The hollow chamber 130 may contain therewithin one or more sheets of silica fibers 135. In various embodiments, the silica fiber sheets 135 provide vastly increased surface area within the chamber 130 for the capture of sound and gases resulting from discharge of the firearm and as the projectile fired from the firearm traverses through the projectile path 115.

In various embodiments, one or more structural portions of the sound suppressor 100 itself may include, consist essentially of, or consist of a composite material that includes silica fibers and/or powder derived therefrom as described herein. Such embodiments may also feature silica fiber sheets 135 within the hollow chamber 130, or such embodiments may have no filler material within chamber 130 or a different filler material (e.g., metallic mesh or foam) within chamber 130 (such different filler materials may also incorporate silica fibers and/or powder within hollow portions thereof). In various embodiments, the sound suppressor 100 may be fabricated (via, e.g., casting, molding such as injection molding, etc.) from one or more metal and/or plastic materials within silica fibers and/or powder mixed therewithin.

Figure 2A:
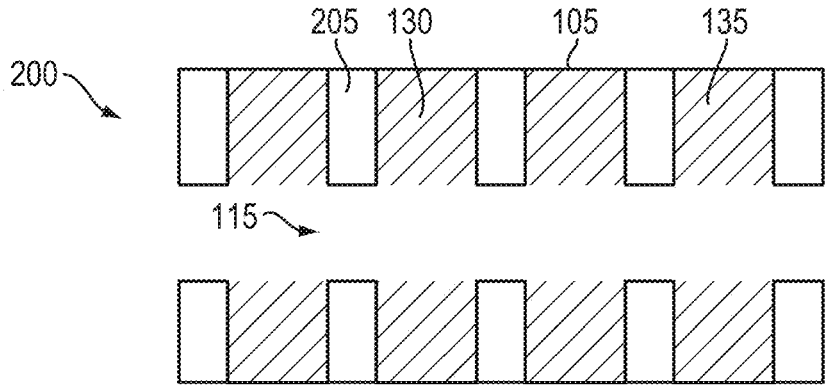
FIG. 2A is a cross-sectional schematic of a sound suppressor in accordance with embodiments of the invention.
Figure 2B:
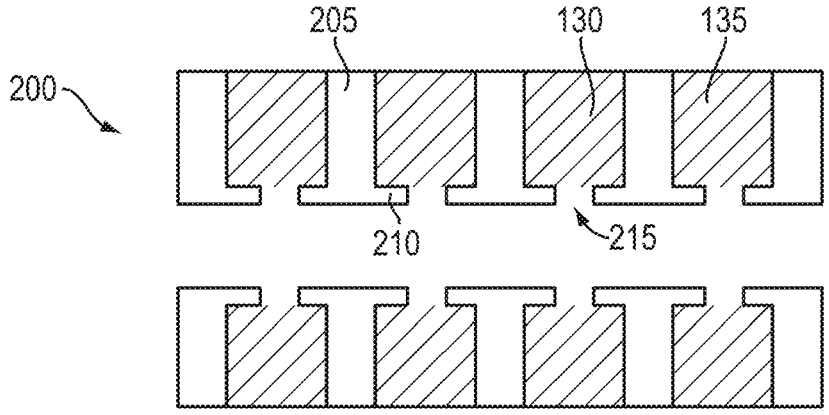
FIG. 2B is a cross-sectional schematic of a sound suppressor in accordance with embodiments of the invention.

FIG. 2A is a cross-sectional schematic of a sound suppressor 200 in accordance with embodiments of the invention. As shown, sound suppressor 200 incorporates multiple baffles 205 that extend from the outer wall of the sound suppressor toward the projectile path 115. In this manner, the baffles 205 may form multiple chambers (or "compartments") 130 separated by the baffles 205. One or more sheets of silica fibers 135 may be disposed within one or more of the chambers 130. While FIG. 2A depicts the baffles 205 straight and as extending substantially perpendicular to the outer wall of the sound suppressor 200 and perpendicular to the projectile path 115, in other embodiments, the baffles 205 may have other configurations. For example, one or more of the baffles may be curved and/or may be oriented at an angle to the projectile path 115 other than 90° (i.e., slanted). As shown in FIG. 2B, one or more of the baffles 205 may define projections 210 that may reduce the size of the apertures 215 defined between the baffles 205 and that partially enclose the chambers 130.

As detailed above for sound suppressor 100, one or more structural portions of the sound suppressor 200 (e.g., one or more wall portions and/or baffles 205) may include, consist essentially of, or consist of a composite material that incorporates silica fibers and/or powder therefrom.

Figure 2C:
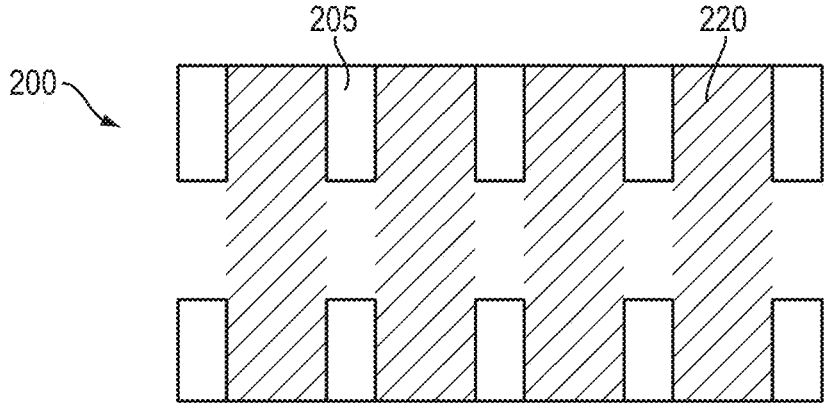
FIG. 2C is a cross-sectional schematic of a sound suppressor in accordance with embodiments of the invention.

As shown in FIG. 2C, the silica fiber sheet disposed within one or more of the chambers 130 may extend at least a portion across the projectile path 115 itself. In this manner, one or more "wipes" 220 of silica fiber sheet may be formed across the projectile path 115. When the projectile discharged from the firearm, it penetrates through each wipe 220, and the heat and gases associated with the projectile are funneled into the chambers 130 more efficiently, as they cannot penetrate the wipe 220 as easily before the projectile has penetrated it.

In various embodiments of the invention, the silica fiber sheets 135 that may be present within one or more chambers 130 of the sound suppressor may also incorporate a liquid or gelatinous material to facilitate heat absorption. For example, water, grease, glycerol, and/or an aqueous gel may be incorporated with and/or within the silica fiber sheets 135. The liquid or gelatinous material may provide additional cooling, thereby also reducing the volume of the combustion gases requiring capture in order to suppress sound related to discharge of the firearm.

Figure 2D:
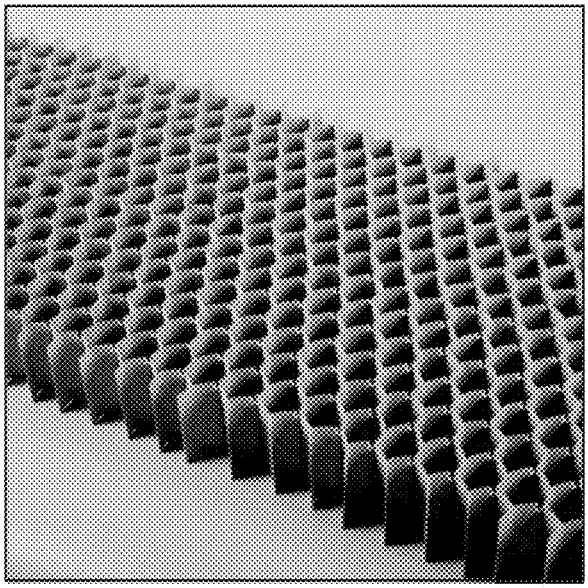
FIGS. 2D-2F depict compartmented sheets utilized to form portions of sound suppressors or suppressor sleeves in accordance with embodiments of the invention.
Figure 2E:
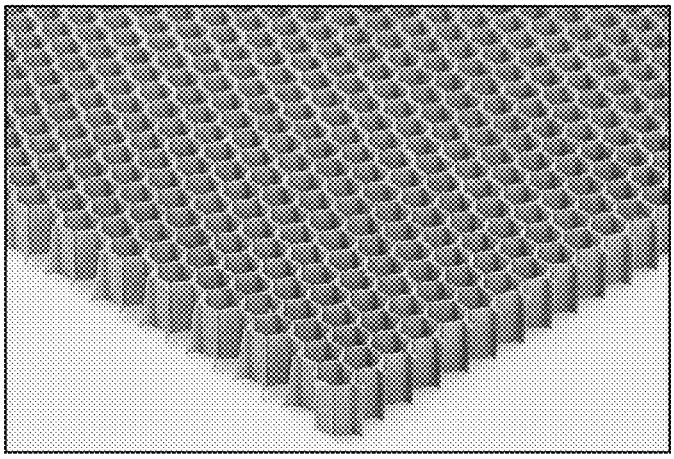
Figure 2F:
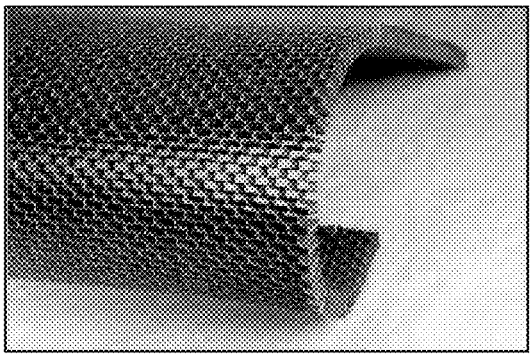
Figure 2G:
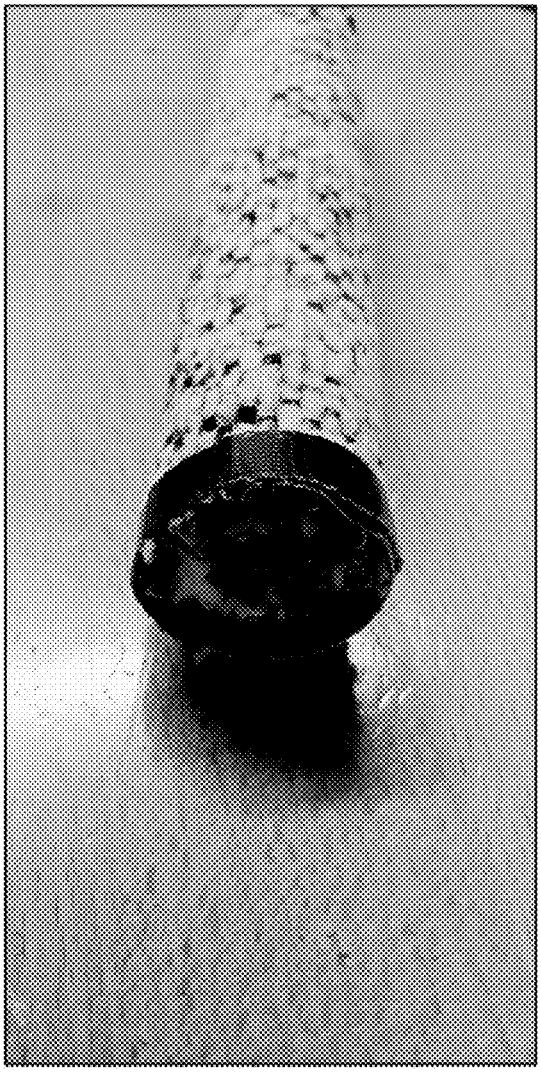
FIGS. 2G and 2H depict a sound suppressor in accordance with embodiments of the invention.
Figure 2H:
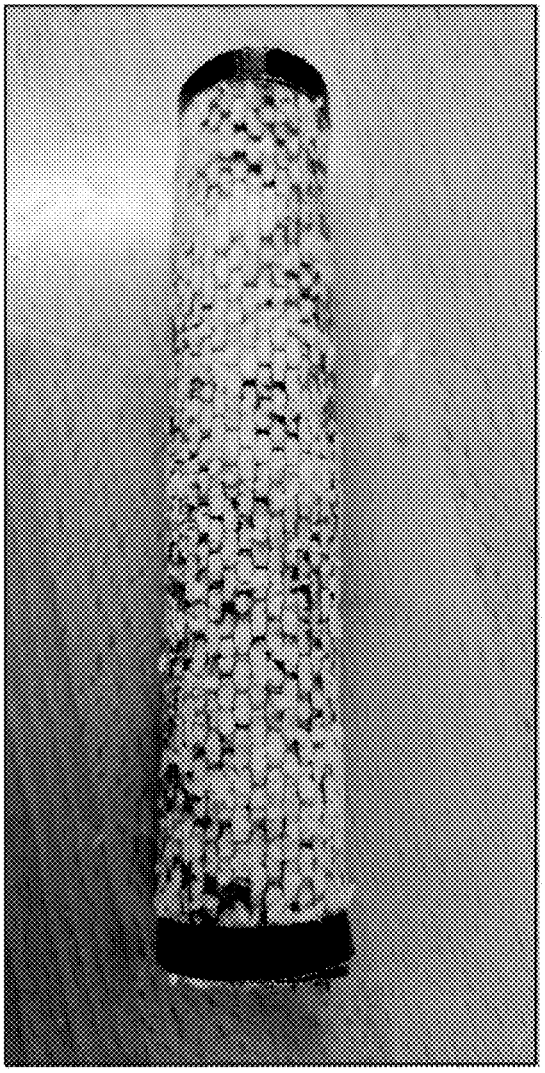

In various embodiments, a compartmented (or "honeycomb") tube or sheet is utilized to form all or a portion of the sound suppressor 200, as shown in FIGS. 2D-2F. In such embodiments, the hollow compartments of the compartmented sheet or tube form the chambers 130, while the dividers therebetween form the baffles 205. As shown in FIGS. 2D-2F, the chambers 130 may therefore have any number of possible shapes, e.g., hexagonal, rectangular, etc. As shown in FIG. 2F, a compartmented sheet may be flexible and therefore deformable into a tube of the desired shape and size. In other embodiments, a compartmented tube may be initially fabricated in a tubular shape. In various embodiments, a sheet of silica fibers may be placed into (and/or over) all or some of the compartments 130 defined by the sheet or tube, as shown in FIGS. 2G and 2H. For example, portions of a mat or sheet of silica fibers may be pressed into the compartments. Thereafter, in various embodiments, the compartmented tube may be inserted into a casing that forms the outer wall 105 of the suppressor 200. The casing may include, consist essentially of, or consist of, for example, a plastic and/or metallic material. In various embodiments, the casing itself may incorporate silica fibers and/or silica powder within its structural matrix, as detailed above. The casing may also include an attachment mechanism 120 for attachment to a firearm muzzle. In other embodiments, the compartmented sheet has a solid bottom surface disposed below the compartments of the sheet, and this solid surface becomes the outer wall 105 of the suppressor 200 when the sheet is formed into a tube.

As mentioned above, sound suppressors in accordance with embodiments of the present invention may be detachable from firearms or integrated therewith as a portion of a unitary barrel or muzzle of the firearm. Thus, embodiments of the present invention also include firearms incorporating, as detachable or undetachable components, sound suppressors as detailed herein. For embodiments featuring silica sheets, fibers, and/or powder, the firearms may be configured such that the silica material may be replaced periodically (e.g., as a consumable component of the firearm). For example, the sound suppressor may be openable and/or detachable from the firearm such that spent silica material may be removed and/or new silica material may be introduced into the sound suppressor.

In various embodiments, the firearm includes a housing configured to receive ammunition therein. For example, the housing may simple feature an aperture configured to receive manually loaded ammunition, or the housing may be configured to receive and interface with "clips" containing multiple rounds of ammunition. Typically, a hollow cylindrical barrel extends from the housing. Firearms in accordance with embodiments of the invention also typically feature a firing mechanism configured to control the firing of the ammunition from the firearm through the barrel toward an intended target. For example, the firing mechanism may include, consist essentially of, or consist of a trigger or other manually actuated mechanism such as a button or switch. More complex firing mechanisms, for example for larger, more complex firearms, include computer-controlled actuators that may be controlled on the firearm itself or at a distance therefrom (e.g., via wired or wireless communication). The barrel itself has a central bore through which the ammunition travels, and the central bore (or "projectile path") of the sound suppressor is typically aligned with the central bore of the barrel so that the ammunition travels through the sound suppressor when fired from the firearm. (Note that "alignment" of the central bores of the sound suppressor and barrel does not require absolute alignment or overlap of these hollow features. Rather, "aligned," as utilized herein, requires only sufficient alignment to allow and enable ammunition fired from the firearm to travel through the barrel and sound suppressor. In fact, for example, the bore of the sound suppressor may be larger than that of the barrel to facilitate alignment thereof.)

In other embodiments of the invention, silica fibers (e.g., a silica fiber sheet or portion thereof) and/or powder formed therefrom are utilized within or as an insulating sleeve disposed around a sound suppressor, and/or around a portion of the firearm itself (e.g., all or a portion of the barrel). In various embodiments, the insulating sleeve is utilized with a suppressor 100 or 200 that itself incorporates the silica fibers and/or powder, as described above. In other embodiments, the insulating sleeve is utilized with a conventional sound suppressor. Sleeves for sound suppressors in accordance with embodiments of the invention may be configured to be removable (and therefore replaceable), or they may be a portion of a unitary "sleeved" suppressor (i.e., an insulating portion of a single component). For example, a suppressor sleeve in accordance with various embodiments may include, consist essentially of, or consist of a sheet of silica fibers that may be wrapped and/or fit around all or a portion of a sound suppressor and/or all or a portion of the firearm itself (e.g., the barrel).

Figure 1B:
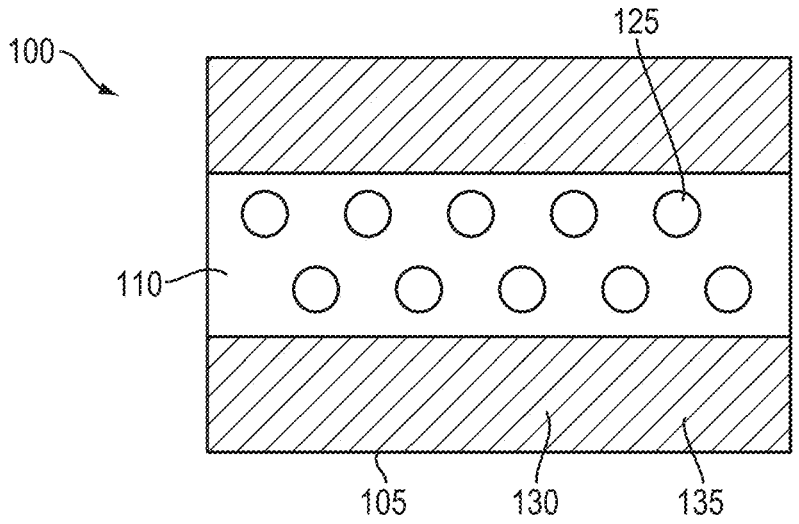
FIG. 1B is a schematic cutaway view of the sound suppressor of FIG. 1A.
Figure 3:
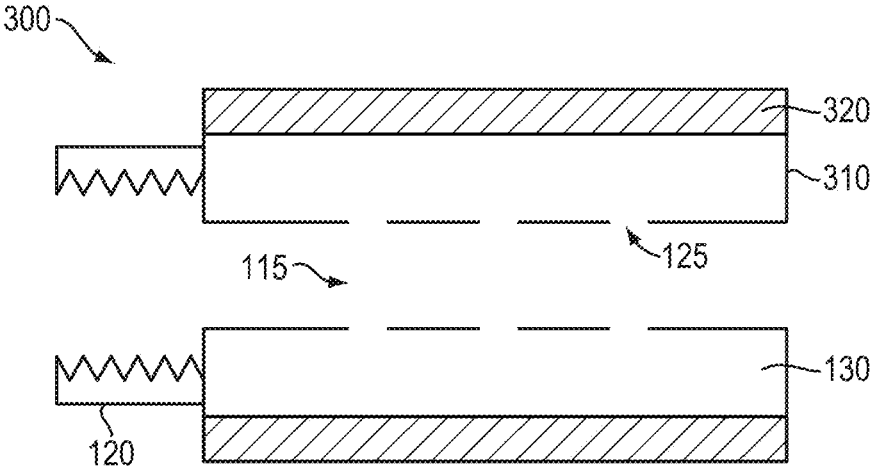
FIG. 3 is a cross-sectional schematic of a sleeved sound suppressor in accordance with embodiments of the invention.
Figure 4A:
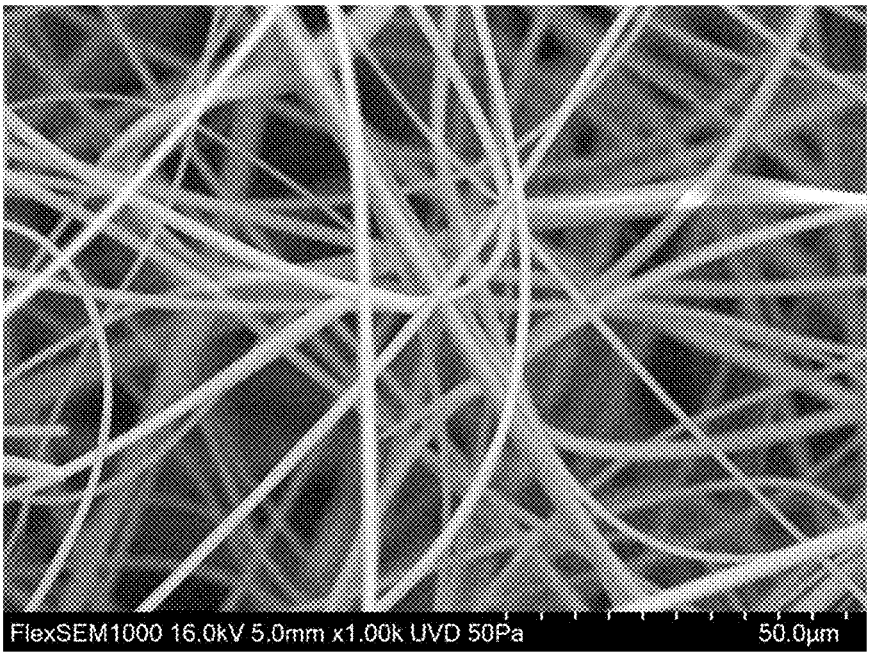
FIGS. 4A-4D are scanning electron microscopy (SEM) images of fibers spun in accordance with embodiments of the invention. Images in FIGS. 4A-4D are at, respectively, 50, 100, 200, and 500 micron scale.
Figure 4B:
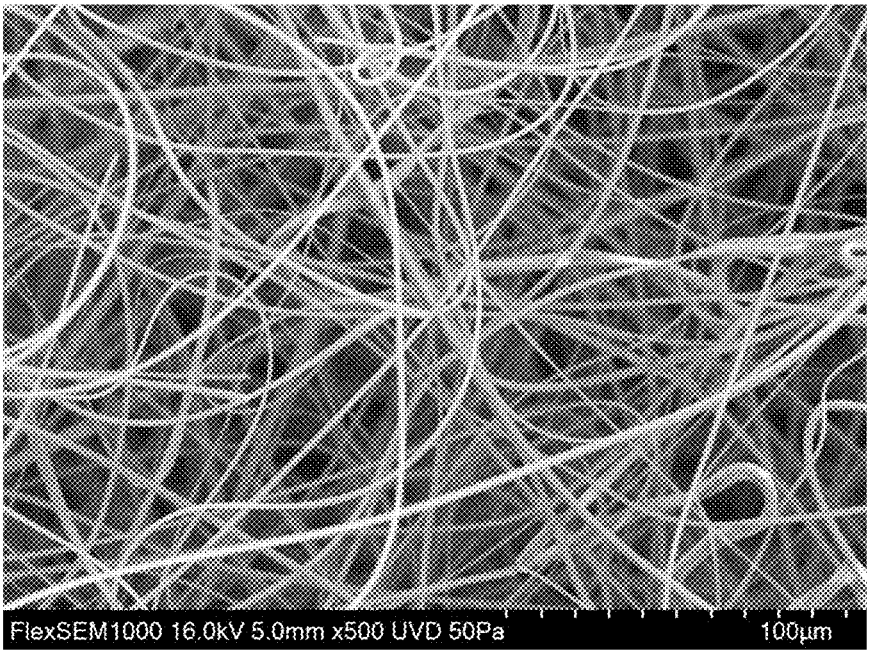
Figure 4C:
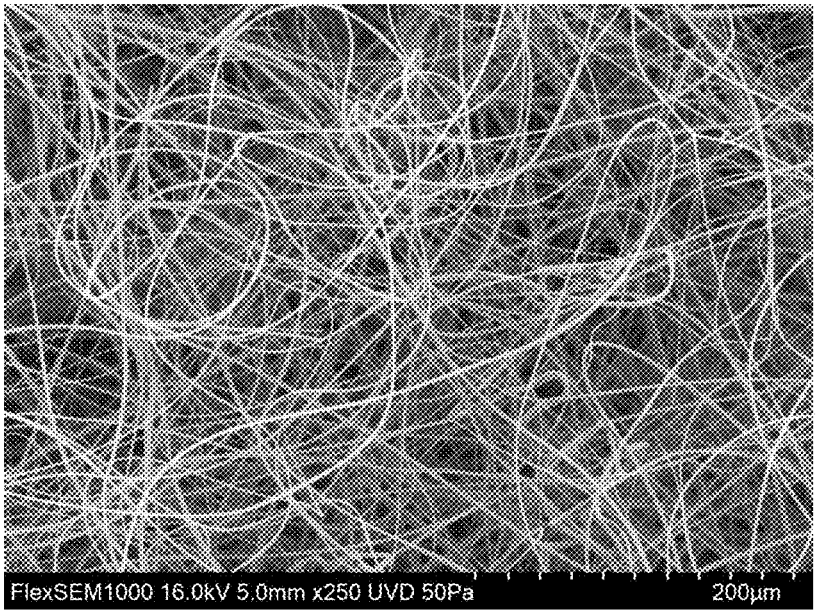
Figure 4D:
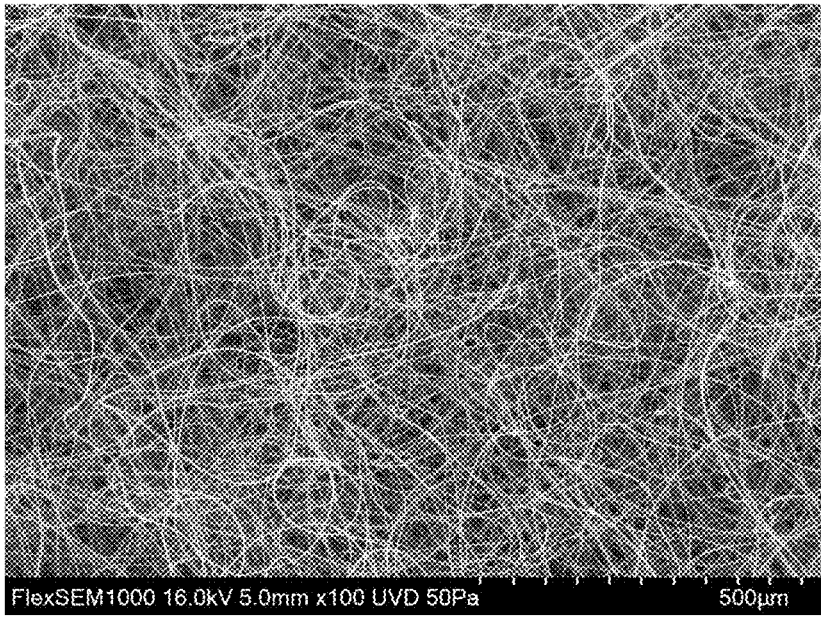

FIG. 3 schematically depicts a sleeved sound suppressor 300 in accordance with embodiments of the invention. As shown, the sleeved suppressor 300 may include a suppressor 310, which may be, for example, a conventional sound suppressor or a suppressor 100, 200 as detailed herein. Disposed around all or a portion of the suppressor 310 is a sleeve 320 that incorporates within silica fibers, silica fiber sheet, and/or silica fiber powder. In various embodiments, the sleeve 320 is an integral portion of the sleeved suppressor 300. For example, the sleeve 320 may be an initially hollow (e.g., annular) portion of the suppressor itself, and silica fiber, sheet, and/or powder may be disposed within the sleeve 320 before the sleeved suppressor is utilized with a firearm. After the silica fiber, sheet, and/or powder is disposed within the hollow interior of the sleeve 320, the sleeve may be sealed (e.g., via welding or brazing, or via a solid cover). In various embodiments, the silica fiber, sheet, and/or powder may be dispersed within a liquid (e.g., water, glycerol, or other suitable liquid) or gelatinous (e.g., a gel such as a polymer hydrogel) carrier disposed within the sleeve 320. The outer surface of the sleeve 320 may include, consist essentially of, or consist of, for example, a polymeric and/or metallic material. In various embodiments, the outer surface of the sleeve 320 includes, consists essentially of, or consists of the same material as that of the suppressor 310. In various embodiments, the hollow chamber(s) 130 of the suppressor 310 may be empty or, as shown in FIGS. 1A and 1B, themselves contain silica fiber, sheet, and/or powder. In various embodiments, the sleeve 320 may be removable from (and, for example, replaceable on) the suppressor 310. For example, the silica fiber, sheet, and/or powder may be disposed on a flexible sheet or within a flexible envelope that may be wrapped around (and/or adhered to) the suppressor 310. In various embodiments, the inner surface of the sleeve 320 may include an adhesive material to adhere the sleeve 320 to the suppressor 310. In other embodiments, the silica fiber, sheet, and/or powder may be disposed within a rigid sleeve 320 that fits around the suppressor 310. For example, the sleeve 320 may slide into place over the suppressor 310 from one of the ends thereof.

In various embodiments, the sleeve 320 may be disposed around a portion of the firearm itself, e.g., all or a portion of the barrel, instead of or in addition to around the suppressor 310. In such embodiments, the sleeve 320 may advantageously dissipate heat from the barrel and/or prevent heating of the barrel due to firing of the firearm.

In various embodiments, the suppressor sleeve may incorporate or be mounted upon a positioning mechanism that enables the sleeve to be disposed around the suppressor and/or firearm muzzle while the firearm is being fired. In various embodiments, after the firearm is fired, and the sleeve minimizes heating of the suppressor and/or muzzle, the sleeve may be at least partially removed from the suppressor and/or muzzle, in order to, e.g., allow any remnant heat to escape to the ambient, thereby enabling more rapid cooling of the firearm (and/or component thereof). For example, the sleeve may slide out of place, off of the suppressor and/or muzzle, after firing, and slid back into place after a desired amount of time and/or after the firearm, component thereof, and/or suppressor has cooled to a desired temperature. In various embodiments, the positioning mechanism may include, consist essentially of, or consist of, for example, a frame with an outer slide on which the sleeve may be disposed.

As mentioned above, suppressor sleeves in accordance with embodiments of the present invention may be detachable from firearms or integrated therewith as a portion of a unitary barrel or muzzle of the firearm. In addition, suppressor sleeves in accordance with embodiments of the invention may be detachable from sound suppressors or integrated therewith as a portion of a unitary sleeved sound suppressor, whether or not the sound suppressor itself is detachable from the firearm. Thus, embodiments of the present invention also include firearms incorporating, as detachable or undetachable components, suppressor sleeves as detailed herein, disposed on or over a sound suppressor and/or a portion of the firearm (e.g., all or a portion of the barrel). For embodiments featuring silica sheets, fibers, and/or powder, the "sleeved" firearms may be configured such that the silica material may be replaced periodically (e.g., as a consumable component of the firearm). For example, the suppressor sleeve may be openable and/or detachable from the firearm such that spent silica material may be removed and/or new silica material may be introduced into the suppressor sleeve. In various embodiments, as described above, the firearm may include, consist essentially of, or consist of a housing configured to receive ammunition therein, a barrel extending from the housing, and a firing mechanism.

EXAMPLES

Example 1: Preparation of Silica Fiber Mat, Powder, and Sound Suppressor

Silica fibers were prepared using an electrospinning process, in which a sol-gel was spun onto a collector drum to form a non-woven mat of fibers. The sol-gel was made in two parts. First, TEOS was mixed with ethanol, and then a second mixture containing HCl, water, and ethanol was titrated into the mixture. The sol-gel was then allowed to ripen for a few days under controlled conditions before spinning.

In one example, the first sol was made by weighing out 384 grams of TEOS 98% and 41.8 grams of anhydrous denatured ethanol, and pouring together. The first sol was allowed to let stand in a beaker, and a magnetic stirrer was used to create a homogenous solution. The second sol was made by weighing 41.8 grams of anhydrous denatured ethanol, 16.4 grams of distilled water, and 0.34 grams of hydrochloric acid, which was then poured together and mixed for 8 seconds with a magnetic stirrer until a homogenous second sol was formed.

The second sol was then poured into the titration device, which was placed above a beaker containing the first sol. The titration device then dripped about 5 drops per second until a third sol was formed via the mixing of the first sol and the second sol. During the dripping process, the first sol was continuously mixed with a magnetic stirrer while the second sol was dripped into the first sol.

The combined third sol was then placed into an enclosure box. A low pressure vacuum was provided by a fan on medium speed to remove fumes. The air temperature within the box was 72° F. with 60% humidity. The third sol was allowed to sit and process for about three days. The mixtures were agitated daily to reduce the build-up of crystalline structures. The third sol began to transition to sol-gel with evaporation of the alcohol solvent. Sol-gel may be monitored to determine an approximate amount of $C_2H_4$ (ethylene) in the vapors, which may be in the range of about 10-20% relative to that of the original sol before ripening. Upon proper gelatinization, the sol-gel was loaded into electrospinning machine or was frozen to preserve for electrospinning. In this example, proper gelatinization occurred when the total mass of the sol-gel was between about 70 grams and about 140 grams. This example may be scaled appropriately and the ranges may vary, yet still produce desirable structures. To further identify the ideal time to electropsin, portions of the gel may be dripped into the electric field of the spinning apparatus to evaluate the spinning properties of the sol-gel.

Figure 5:
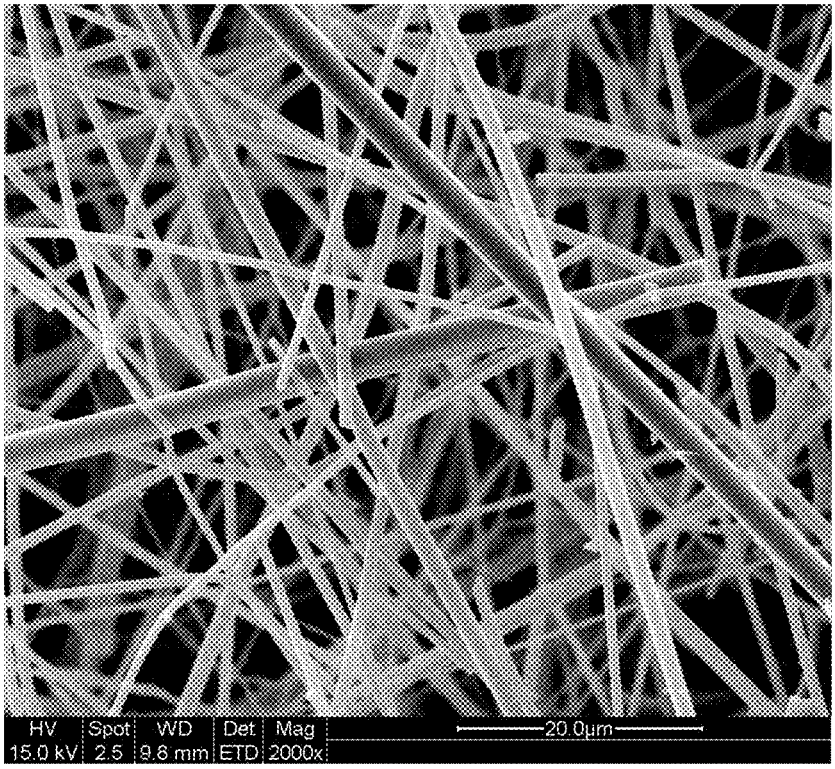
FIG. 5 shows an SEM image (20 micron scale is shown) of fibers spun in accordance with embodiments of the invention after less ripening time than the figures shown in FIGS. 4A-4D.
Figure 6:
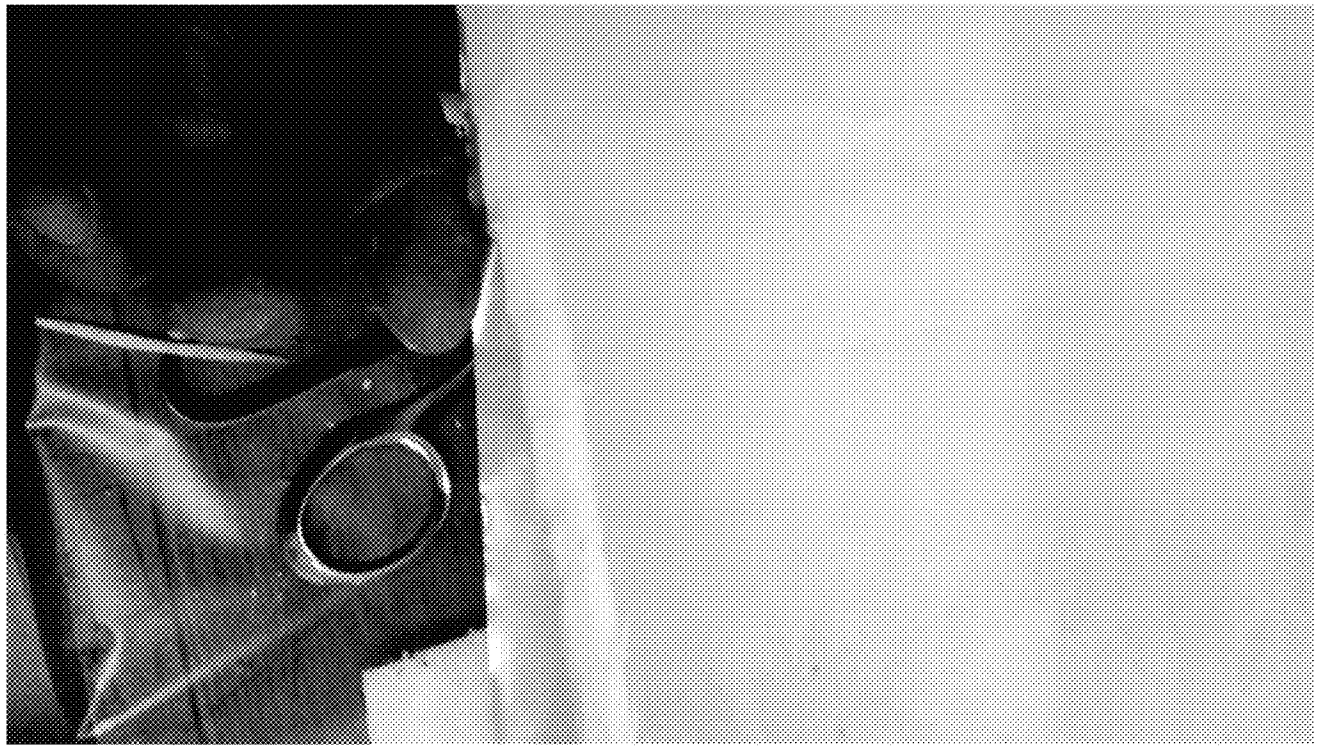
FIG. 6 shows a fiber mat spun with a thickness of about ¼ inch in accordance with embodiments of the invention.

FIGS. 4A-4D are scanning electron microscopy (SEM) images of fibers spun in accordance with embodiments of the invention (50, 100, 200, and 500 micron scales shown). As shown, the fibers are flexible, smooth, dense, and continuous (not significantly fractured). FIG. 5 is an SEM image of fibers that were electrospun after less ripening time (20 micron scale shown), where the fibers are clearly rigid with many fractures clearly evident. Such fibers, in various embodiments, may be more brittle and more easily processed into silica fiber powder. FIG. 6 shows a fiber mat spun in accordance with embodiments of the invention. The flexibility and continuity of the fibers allows mats to be spun at a thickness of ¼ inch or more. The mat has a soft, flexible texture.

Figure 7A:
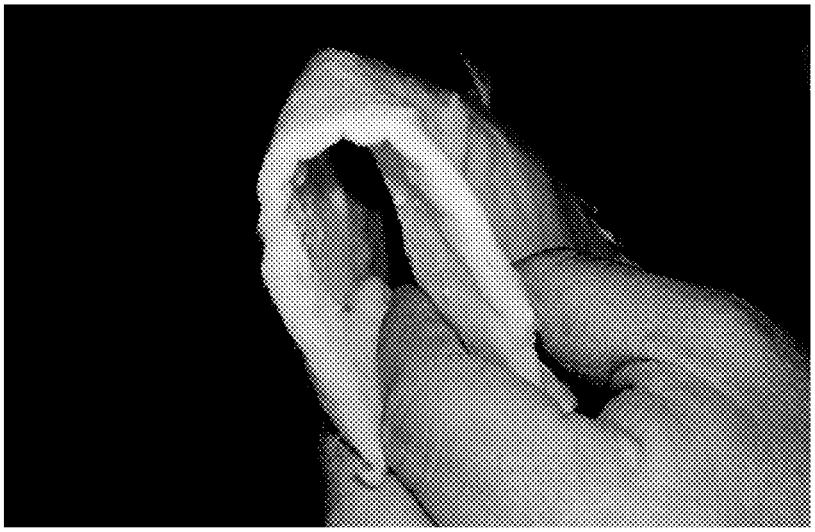
FIGS. 7A and 7B compare a silica fiber mat that was electrospun after a longer transitioning time in accordance with embodiments of the invention (FIG. 7A), with a fiber mat electospun after a shorter transition time in accordance with other embodiments of the present invention (FIG. 7B).
Figure 7B:
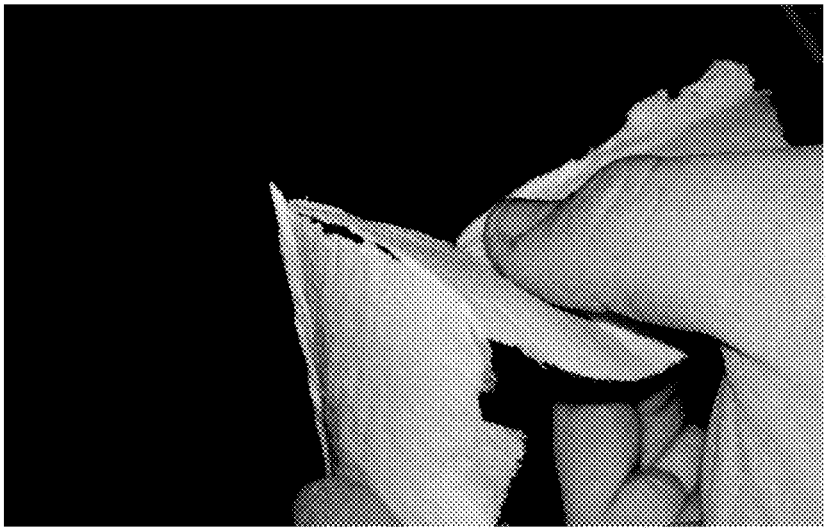

FIGS. 7A and 7B are images depicting the variation of properties of silica fiber mats as a function of ripening time. The mat of FIG. 7A is illustrative of mats electrospun for at least 2-3 days in accordance with embodiments of the invention, while the mat of FIG. 7B is illustrative of mats electrospun after less ripening time. The material in FIG. 7A has a soft texture and is very flexible; such material may still be processed into fiber dust or used in sheet form. The material in FIG. 7B is brittle, inflexible, and thin, and may be easily processed into fiber dust.

Figure 8A:
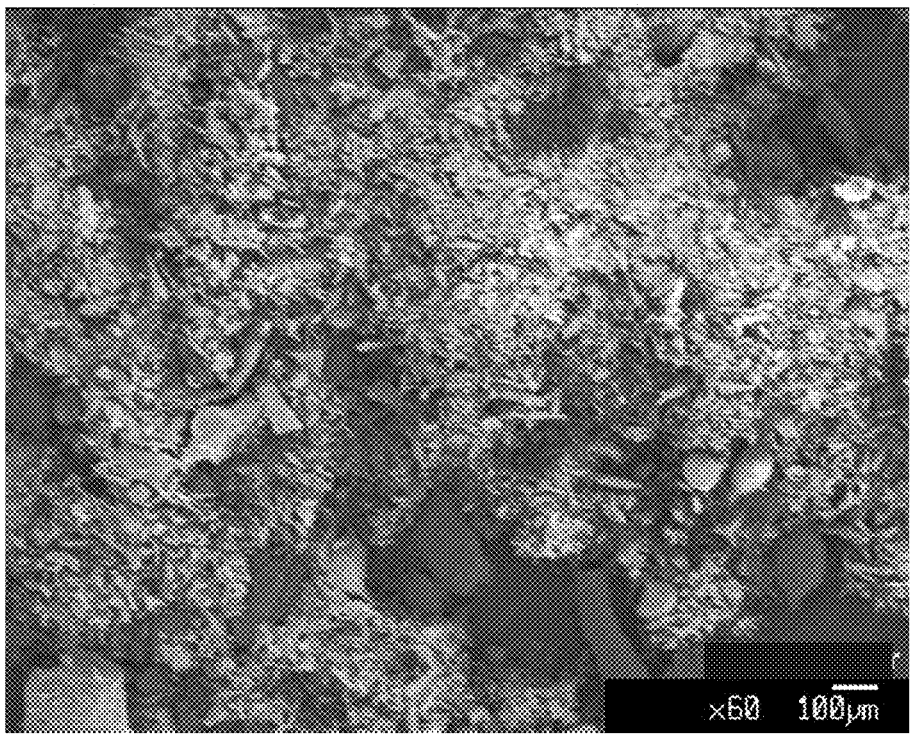
FIGS. 8A and 8B show SEM images of fiber dust in accordance with embodiments of the invention, with 100 μm scale shown.
Figure 8B:
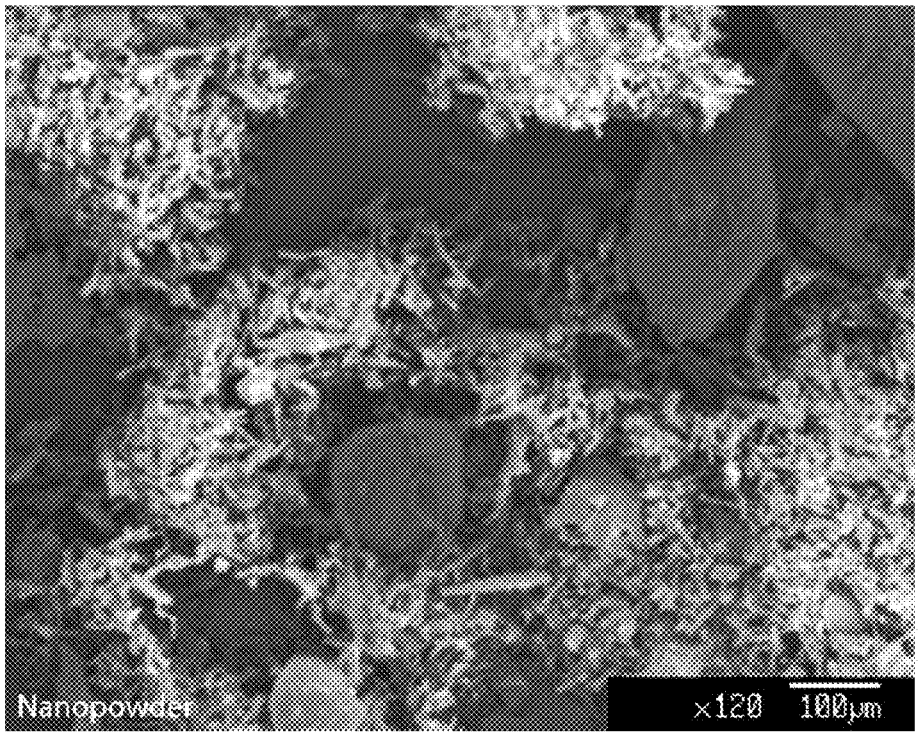
Figure 9A:
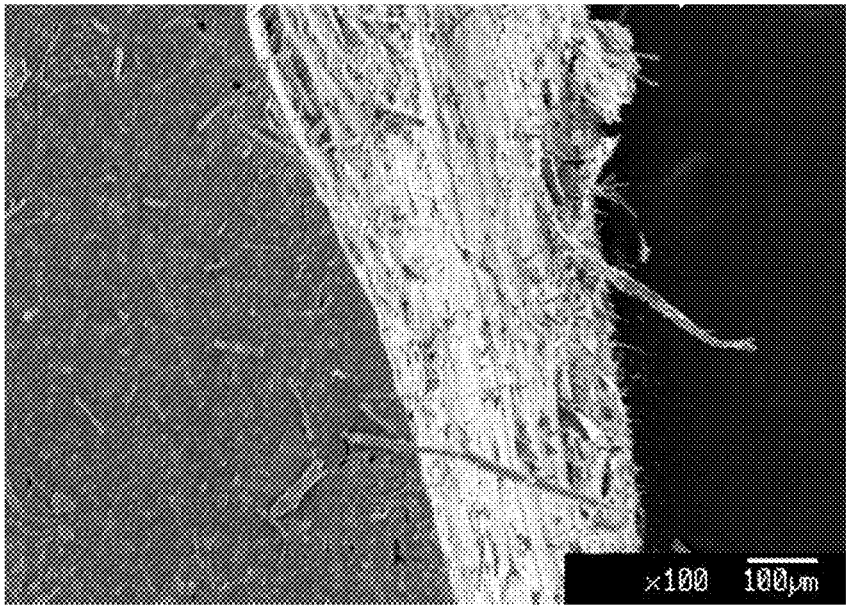
FIGS. 9A and 9B are SEM images of a portion of a molded sound suppressor in accordance with embodiments of the invention, after curing, containing silica fibrous fragments embedded therewithin.
Figure 9B:
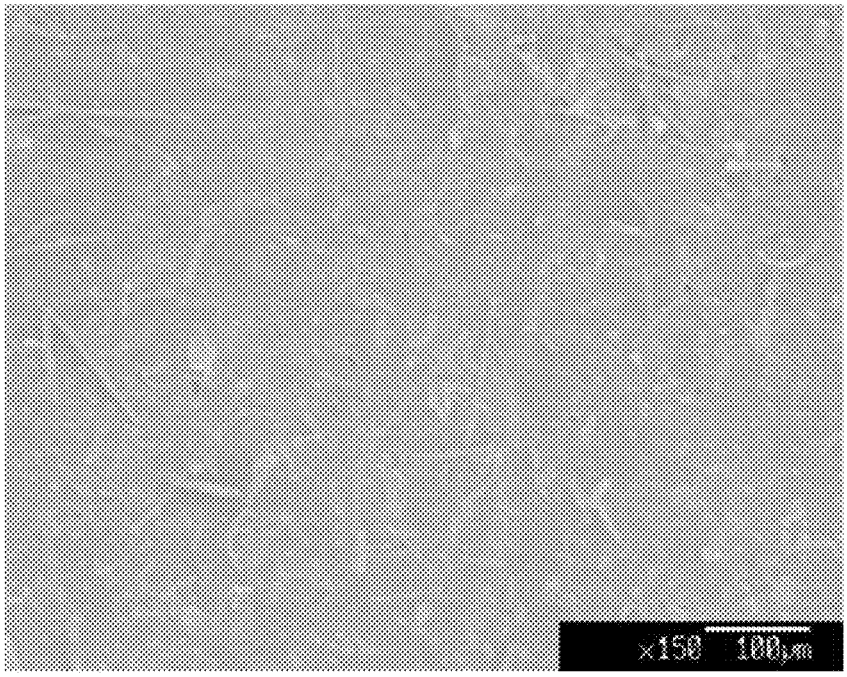

A silica fiber mat was fabricated and broken into fragments by rubbing through a series of screens of decreasing mesh size. The final screen was a 200 mesh screen, resulting in fiber dust and/or fibrous fragments having sizes of approximately 20 μm to approximately 200 μm. FIGS. 8A and 8B show SEM images of the resulting fiber dust, with 100 μm scale shown. FIGS. 9A and 9B are SEM images of a portion of a molded polyurethane composite sound suppressor in accordance with embodiments of the invention, after curing of the polyurethane, containing silica fibrous fragments embedded therewithin.

Example 2: Preparation and Testing of Sleeved Sound Suppressor

A silica fiber mat was prepared in accordance with Example 1. In order to test the effectiveness of a suppressor sleeve in accordance with embodiments of the present invention, the mat of silica fibers was wrapped around a portion of a conventional suppressor, which was fit to the barrel of an AR-15-type rifle configured to fire 5.56 mm ammunition. The mat of silica fibers was wet with water to ensure a tight fit to the suppressor, and most of the water had evaporated prior to the test. For this test, the mat of silica fibers was wrapped around the middle portion of the suppressor, and the opposing ends of the suppressor and the end of the rifle muzzle were not covered with the mat of silica fibers. Seventy rounds were fired from the rifle in quick succession, and then a thermal camera was utilized to image the partially sleeved suppressor and thereby determine the temperature at various locations thereon.

Figure 10A:
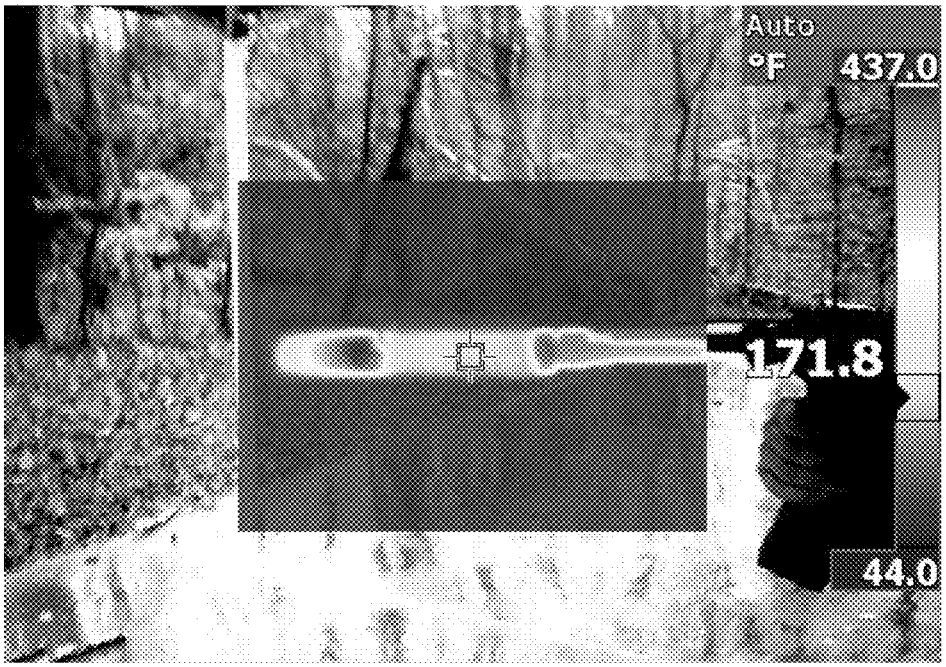
FIG. 10A is a thermal image of a sleeved suppressor, in accordance with embodiments of the invention, and a rifle barrel at around 30 seconds after firing of the rifle.

Immediately after the seventy rounds of ammunition were fired, the uncovered portions of the suppressor and the rifle muzzle were measured to be over 430° F., while the suppressor sleeve over the middle portion of the suppressor measured at only approximately 180° F. FIG. 10A depicts a thermal image of the sleeved suppressor and rifle barrel at around 30 seconds after firing. As shown, the unsleeved portions of the suppressor and barrel measure at well over 400° F., while the sleeve itself measures at only about 171° F. Thus, the sleeve fabricated from the mat of silica fibers was effective in reducing the post-firing temperature of the suppressor by over a factor of two.

Figure 10B:
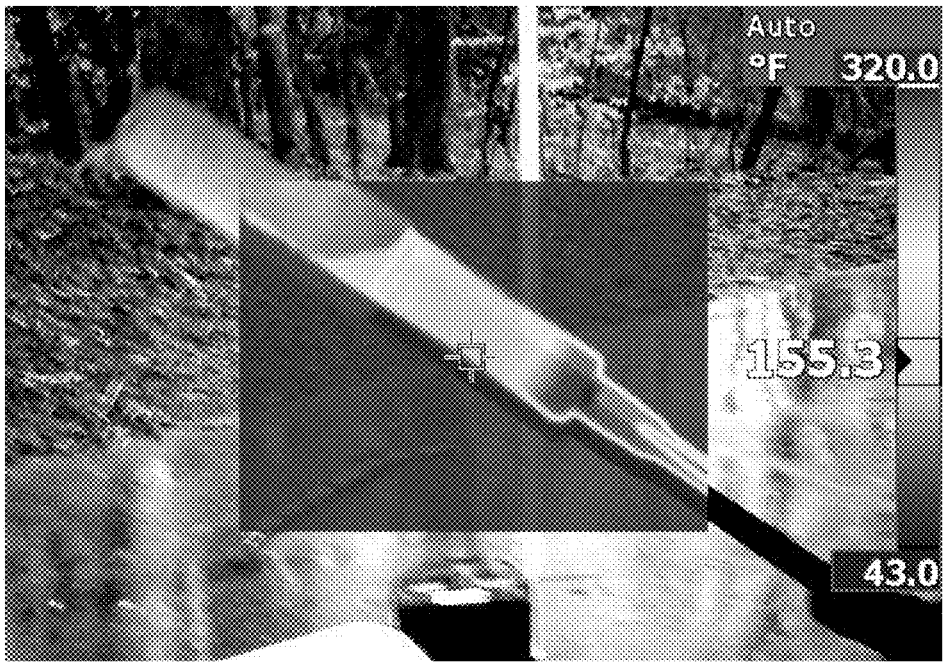
FIG. 10B is a thermal image of the suppressor and rifle barrel shown in FIG. 10A after displacement of the sleeve.

In order to show that the sleeve itself did not merely confine the firing-related heat beneath it, and therefore lead to deleteriously excessive temperatures of the sleeved suppressor, the sleeve was subsequently slid forward along the suppressor, thereby revealing for thermal imaging the previously sleeved region of the suppressor. FIG. 10B depicts the thermal image after displacement of the sleeve, at a time approximately four minutes after the firing had ceased. As shown, the previously sleeved portion of the suppressor displayed a temperature of only approximately 155° F., while the portion of the suppressor proximate the end of the barrel (which had not been sleeved during firing) still exhibited a temperature of over 300° F. Thus, the sleeve of silica fibers was demonstrated to prevent heating of the sleeved portion of the suppressor without merely confining deleteriously large amounts of heat beneath the sleeve where it could damage the sleeved suppressor.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

The invention claimed is:

1. A sound suppressor for a firearm, the sound suppressor comprising:

a cylindrical shell defining a hollow projectile path along a central longitudinal axis of the shell and having an outer surface and an inner surface;

disposed at one end of the shell, an attachment mechanism configured to attach the shell to a muzzle of the firearm;

defined within the shell, one or more chambers fluidly coupled to the projectile path via one or more apertures defined in the inner surface of the shell; and a sheet of silica fibers disposed within at least one of the chambers, wherein the sheet of silica fibers extends at least partially through the projectile path.

2. The sound suppressor of claim 1, wherein at least a portion of the shell comprises a matrix material and, dispersed therewithin, a plurality of silica fibers, silica powder, and/or fibrous fragments of silica fibers.

3. The sound suppressor of claim 2, wherein the matrix material comprises at least one of a plastic or a metal.

4. The sound suppressor of claim 1, wherein the one or more chambers comprises a plurality of chambers separated by baffles disposed within the shell, the apertures being disposed between the baffles.

5. The sound suppressor of claim 1, wherein the sheet of silica fibers is at least a portion of a non-woven mat of silica fibers formed by electrospinning a sol-gel.

6. The sound suppressor of claim 5, wherein the sol-gel is produced from an initial sol comprising 70% to 90% TEOS, 8% to 25% anhydrous ethanol, an acid catalyst, and water.

7. The sound suppressor of claim 6, wherein the sol-gel is produced, at least in part, by ripening the initial sol for at least 2 days at a humidity of 40% to 80% and a temperature of 50° F. to 90° F.

8. The sound suppressor of claim 7, wherein the initial sol is ripened for at least 3 days.

9. The sound suppressor of claim 1, wherein fibers of the sheet of silica fibers have diameters ranging from approximately 50 nm to approximately 5 μm.

10. The sound suppressor of claim 1, wherein fibers of the sheet of silica fibers have diameters ranging from approximately 200 nm to approximately 1000 nm.

11. A firearm configured for sound suppression, the firearm comprising:

a housing configured to receive ammunition therein;

a hollow cylindrical barrel extending from the housing;

a firing mechanism configured to control firing of the ammunition, through the barrel, from the firearm; and a sound suppressor coupled to the barrel and comprising one or more sheets of silica fibers therein, wherein the sound suppressor comprises:

a cylindrical shell defining a hollow projectile path along a central longitudinal axis of the shell and having an outer surface and an inner surface, the projectile path being aligned with a central bore of the barrel, and defined within the shell, one or more chambers fluidly coupled to the projectile path via one or more apertures defined in the inner surface of the shell, wherein the one or more sheets of silica fibers are disposed within at least one of the chambers, and wherein at least one said sheet of silica fibers extends at least partially through the projectile path.

12. The firearm of claim 11, wherein at least a portion of the shell comprises a matrix material and, dispersed therewithin, a plurality of silica fibers, silica powder, and/or fibrous fragments of silica fibers.

13. The firearm of claim 12, wherein the matrix material comprises at least one of a plastic or a metal.

14. The firearm of claim 12, wherein the one or more chambers comprises a plurality of chambers separated by baffles disposed within the shell, the apertures being disposed between the baffles.

15. The firearm of claim 11, wherein at least one said sheet of silica fibers is at least a portion of a non-woven mat of silica fibers formed by electrospinning a sol-gel.

16. The firearm of claim 11, wherein fibers of the sheet of silica fibers have diameters ranging from approximately 50 nm to approximately 5 μm.

17. The firearm of claim 11, wherein fibers of the sheet of silica fibers have diameters ranging from approximately 200 nm to approximately 1000 nm.

* * * * *